United States Patent [19]

Sakurai et al.

[11] Patent Number: 4,618,240

[45] Date of Patent: Oct. 21, 1986

[54] HEATING DEVICE HAVING A HEAT INSULATING ROLLER

[75] Inventors: Masaaki Sakurai, Hanno; Kazuo Kagiura, Iokyo, both of Japan

[73] Assignee: Canon Kabushiki Kaisha, Tokyo, Japan

[21] Appl. No.: 475,381

[22] Filed: Mar. 14, 1983

[30] Foreign Application Priority Data

| | | | |
|---|---|---|---|
| Mar. 16, 1982 | [JP] | Japan | 57-42211 |
| Mar. 17, 1982 | [JP] | Japan | 57-42409 |
| Mar. 26, 1982 | [JP] | Japan | 57-49724 |
| Sep. 9, 1982 | [JP] | Japan | 57-157084 |

[51] Int. Cl.[4] ..... G03G 15/20

[52] U.S. Cl. ..... 355/3 FU; 432/60; 219/216

[58] Field of Search ..... 355/14 SH, 15, 14 R, 355/14 CU, 14 C, 14 E, 14 D, 14 TR, 14 FU, 14 CH, 3 FU, 3 DR, 3 DD, 3 R; 100/93 RP; 430/88, 99; 219/216, 388, 469; 432/8, 60, 228

[56] References Cited

U.S. PATENT DOCUMENTS

| | | | |
|---|---|---|---|
| 3,452,181 | 6/1969 | Stryjewski | 355/3 FU |
| 3,832,524 | 8/1974 | Takiguchi | 219/216 |
| 3,918,804 | 11/1975 | Bar-On | 355/3 FU X |
| 3,937,637 | 2/1976 | Moser et al. | 355/3 FU X |
| 3,945,726 | 3/1976 | Ito et al. | 430/99 X |
| 3,951,538 | 4/1976 | Bar-On | 355/3 FU |
| 3,965,853 | 6/1976 | Moser | 430/99 X |
| 3,966,394 | 6/1976 | Braun | 355/15 X |
| 3,993,124 | 11/1976 | Mueller | 355/3 FU X |
| 3,998,584 | 12/1976 | Wada et al. | 100/93 RP X |
| 4,001,545 | 1/1977 | Wada et al. | 219/216 |
| 4,045,164 | 8/1977 | Moser | 355/3 FU X |
| 4,050,886 | 9/1977 | Moser | 355/3 FU X |
| 4,083,092 | 4/1978 | Imperial et al. | 355/3 FU X |
| 4,149,797 | 4/1979 | Imperial | 355/3 FU |
| 4,257,699 | 3/1981 | Lentz | 355/3 FU |
| 4,264,181 | 4/1981 | Lentz et al. | 355/3 FU |
| 4,272,179 | 6/1981 | Seanor | 355/3 FU |
| 4,301,359 | 11/1981 | Ito et al. | 355/3 FU X |
| 4,324,482 | 4/1982 | Szlucha | 355/3 FU |
| 4,372,246 | 2/1983 | Azar et al. | 355/3 FU X |
| 4,480,908 | 11/1984 | Anzai et al. | 355/14 FU X |

FOREIGN PATENT DOCUMENTS

| | | | |
|---|---|---|---|
| 0119160 | 9/1981 | Japan | 355/3 FU |
| 0053773 | 3/1982 | Japan | 355/3 FU |
| 0063570 | 4/1982 | Japan | 355/14 FU |
| 0158886 | 9/1982 | Japan | 355/14 FU |
| 0211180 | 12/1982 | Japan | 355/14 FU |

OTHER PUBLICATIONS

Japanese Laid-Open Utility Model Application No. 145061/1981, Entitled "Fixing Apparatus".

*Primary Examiner*—R. L. Moses

*Attorney, Agent, or Firm*—Fitzpatrick, Cella, Harper & Scinto

[57] ABSTRACT

A heating device having a heating roller for heat-treating an object to be heated or for heat-treating an object to be heated on a support member comprises a heat loss preventing device for preventing heat loss at the end portions of the roller, and a heating device provided internally or externally of the roller to efficiently heat the heating roller and secure a uniform heat distribution on the surface of the roller during heat treatment. The heat loss preventing device has a gear having heat-resistant insulating material and/or an insulating bearing or an insulating sleeve provided between a bearing and the roller, and the heating device has a heating member whose heating distribution is greater in the central portion than in the end portions of the roller or a heating member having a heating distribution area smaller than the maximum width of the support member and in addition, a heating member whose heating distribution is substantially constant or whose heating distribution is greater in the central portion than in the end portions of the roller.

61 Claims, 16 Drawing Figures

HEATING DEVICE HAVING A HEAT INSULATING ROLLER

BACKGROUND OF THE INVENTION 1. Field of the Invention

This invention relates to a heating device for heat-treating an object to be heated, and in particular to a heating device effective to heat and fix unfixed images such as toner images.

2. Description of the Prior Art

In heating devices using heat, it has heretofore been difficult to achieve uniform heating and power saving. Particularly in heat roller fixing devices which are typical fixing devices, there has been a problem that the heat from a heating source provided in the image forming apparatus or the fixing device is lost without being transmitted to the surface of the heat roller for use for fixation. As a result, the heat loss is great at the end portions of the heat roller and the fixing efficiency is greatly reduced.

Also, it has usually been practised to provide a metal plate of a thickness of several millimeters or more or to an insulating member of a thickness of several centimeters around the heating device, as disclosed in U.S. Pat. No. 3,998,584.

In the prior art, design has been made such that the heating distribution of the heating source is stronger in the end areas of the roller to compensate for any temperature drop at the end portions of the heat roller or at the end portions of the pressure roller or the like urged against the heat roller. This has led to increased power consumption in the fixing device, which in turn has led to the necessity of limiting the power supply to other stations in the apparatus or to the unavoidable complication of the temperature control in the fixing device.

On the other hand, even with such approach, the amount of heat lost from the end portions of the heat roller is increased and this induces temperature rise in the interior of the image forming apparatus, which in turn may induce toner blocking in the cleaner or the developing device or thermal deformation of the plastic molded parts in the apparatus.

As another method of solution, it has already been practised to provide an insulating sleeve between the heat roller and the bearing member holding the heat roller or provide a plain bearing formed of resin to decrease the abovedescribed heat loss, as disclosed in U.S. Pat. No. 3,945,726. However, this method cannot after all provide a satisfactory solution but still induces great heat loss which causes a temperature drop in the end portions of the roller.

In the above-described countermeasure wherein it is usually practised to intensify the heating distribution at the end portions of the roller, the power consumption as a whole does not differ from that in the conventional devices.

The above-described method induces not only waste of power but also temperature rise in other portions of the apparatus body, which in turn may result in various problems.

Another countermeasure is proposed in Japanese Laid-open Utility Model Application No. 145061/1981. This method basically comprises interposing an insulating material between the shaft of the heating roller and the gear, and intends to prevent heat dissipation from the end portions of the roller, together with the aforementioned insulating sleeve. However, the heater provided in this heating roller exhibits a large heating compatibility at the end portions of the roller whereat the gear and bearing are mounted and therefore, it expedites deterioration of the insulating material. Also, the thermal imbalance on the surface of the heating roller is increased to cause unsatisfactory fixation to result from heat deficiency in the central portion of the roller, and this complicates the temperature control on the surface of the roller.

Thus, in the devices of the prior art, effective utilization of heat and power could not be achieved. Also, in the devices of the prior art, when continuous fixation of several tens of copies was carried out, the thermal non-uniformity on the surface of the heating roller was increased to prevent sufficient fixation from being accomplished and thus, the apparatus was constrained to be stopped from operation.

In the recent heating devices and image forming apparatuses equipped with the same, power saving is desired for the purpose of effective utilization of power. Further, the advent of a heating device capable of effecting high-speed heat treatment efficiently, uniformly and stably for the object to be heated and the support member therefor is desired.

SUMMARY OF THE INVENTION

It is an object of the present invention to provide a heating device which can overcome the above-noted disadvantages peculiar to the devices of the prior art.

It is another object of the present invention to provide a heating device which can use heat efficiently for heat treatment.

It is still another object of the present invention to provide a heating device which can achieve a particularly excellent heat treating effect even at a high speed as compared with the prior art devices.

It is yet another object of the present invention to provide a heating device in which the time required from after power supply to heating means is started until the heating roller is heated to a predetermined temperature can be reduced.

It is a further object of the present invention to provide a heating device in which the wrinkling created when the object to be heated is heated and fixed on the support member can be greatly prevented.

It is still a further object of the present invention to provide a heating device in which the heat heretofore wastefully lost from the end portions and peripheral surface of the heating roller can be effectively utilized for heat treatment.

Other objects of the present invention will become apparent from the following detailed description taken in conjunction with the accompanying drawings.

DESCRIPTION OF THE PREFERRED EMBODIMENTS

An embodiment in which the present invention is applied to a heating-fixing device will hereinafter be described by reference to FIGS. 1 to 5. In the present embodiment, plain paper P bearing thereon a toner image T formed through the electrophotographic process is used as a member to be heated.

Figure 2:
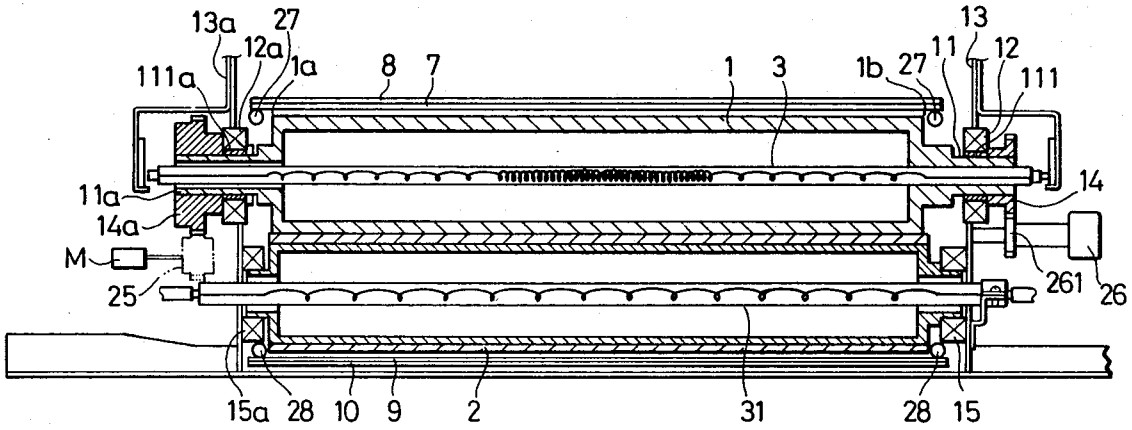
FIG. 2 is a cross-sectional view taken along plane X—X′ of FIG. 1.

Reference numeral 1 designates a heating roller having therein a heater 3 such as a halogen heater. The heating roller 1 is rotatably supported by bearings 12 and 12*a* on the opposite ends thereof as shown in FIG. 2 and is rotatively driven in the direction of the arrow by a drive motor M. Reference numeral 2 denotes a pressure roller having a low-temperature heater 31 therein. The pressure roller 2 is rotatable while being in frictional contact with the heating roller 1.

The heating roller 1 is formed of a metal such as aluminum, stainless steel or copper and a layer of heat-resistant parting resin such as tetrafluoroethylene resin provided on the outer peripheral thereof, the resin layer having a thickness of 20–80 μm.

The pressure roller 2 is rotatably supported by bearings 15 and 15*a* on the opposite ends thereof as shown in FIG. 2 and is urged against the heating roller 1 during at least the fixation by pressure means which will be described later. This roller 2 comprises a relatively thick layer of an elastic material such as silicon rubber, fluorine rubber or fluorosilicon rubber provided on the outer peripheral surface thereof. This construction has as a purpose thereof to secure the area d of pressure contact with the heating roller.

A thermosensitive element 4 such as a thermistor or a thermocouple is disposed in contact with the outer peripheral surface of the heating roller 1, and the detection signal thereof is directed to a known control means (not shown) to maintain the temperature of the outer peripheral surface of the heating roller 1 at a toner image melting temperature (by controlling the output of the heater 3 or the voltage applied thereto).

Designated by 6 is a cleaning member for removing from the surface of the heating roller any foreign material such as offset toner or paper powder adhering to such roller surface. The cleaning member 6 comprises a cleaning web 61 formed of heat-resistant unwoven cloth such as Normex or Himeron. The cleaning web 61 is brought into contact with the heating roller by a resilient push roller 63. The web 61 is moved from a supply roller 62 by a take-up roller 65 so that its contact position changes little by little, whereby a new surface of the cleaning web 61 always comes into contact with the heating roller. This web 61 is moved over a roller 64 subsequent to the push roller 63 and reversed toward the supply roller 62 and taken up onto the take-up roller 65 with the front and back sides thereof reversed. If the cleaning web 61 is impregnated with an offset preventing liquid such as dimethyl silicon oil, the cleaning effect thereof can be further enhanced.

Denoted by 7 is a curved reflecting plate having a heat reflecting property which is provided in proximity to the outer periphery of the heating roller 1 and along the full length of the heating roller 1. The reflecting plate 7 is of such a width which covers the portion of the peripheral surface of the heating roller 1 between the roller 63 and the entrance opening for the paper P. Designated by 8 is a thick insulating cover for preventing heat radiation. The cover 8 is provided in intimate contact with the entire convex surface of the reflecting plate 7 to prevent wasteful heat radiation from the reflecting plate 7. Denoted by 16 is an upper casing member of the fixing device. It surrounds the cleaning member 6, the reflecting plate 7, the adiabatic cover 8 and the thermosensitive element 4.

On the other hand, on the pressure roller 2 side, a reflecting plate 9 similar to the reflecting plate 7 and an insulating cover 10 similar to the cover 8 are provided so as to cover most of the peripheral surface of the pressure roller 2.

Reference numeral 27 designates stoppers above the opposite ends of the heating roller 1. These stoppers 27 are located so that the center of curvature of the reflecting plate 7 and insulating cover 8 is the center of the heating roller 1, and the stoppers 27 maintain the distance l1 between the reflecting plate 7 and the heating roller 1. To improve the reflecting efficiency, the distance l1 should preferably be greater than the thickness of the paper used and less than 10 mm.

On the other hand, the reflecting plate 7 and the cover 8 are made integral with each other and are pivotably supported with respect to a pivot 29, and are normally stably in contact with the stoppers 27 due to their own gravity (of the order of 10 grams).

Designated by 28 are stoppers provided below the opposite ends of the heating roller 1. These stoppers 28 are located so that the center of curvature of the reflecting plate 9 and the insulating cover 10 is the center of the heating roller 1, and the stoppers 28 maintain the distance l2 between the reflecting plate 9 and the pressure roller 2. The distance l2 is similar to the distance 11. The reflecting plate 9 and the cover 10 are pivotable and have a pivot 24 at the end thereof with respect to the circumferential direction of the pressure roller, and one end of a spring 23 secured to a fixed pin 231 is engaged with the other end of the reflecting plate 9. By the spring 23, the inner surface of the reflecting plate 9 is brought into contact with the spherical surfaces of the stoppers 28 with a predetermined pressure (a light pressure).

By the reflecting plates 7, 9 and the insulating covers 8, 10 being so provided, the heat wastefully consumed from the surfaces of the heating and pressure rollers can be reduced and the temperature-measuring property of the thermosensitive element 4 can be stabilized. Also, the temperature tone for the set temperature of the heating roller 1 can be stabilized and the power consumption can be reduced.

Reference numeral 22 designates a guide plate for guiding the paper P toward the heating roller 1. The guide plate 22 is provided in proximity to the heating roller 1 so that it is located between one end of the reflecting plate 7 and one end of the reflecting plate 9. Denoted by 233 is a support plate for supporting the pressure roller. The support plate 233 is supported by a spring 232 engaged at one end with the fixed portion of the device. Thereby the pressure roller is urged against the fixing roller with a predetermined pressure.

Now, the plain paper P having the unfixed toner image T thereon is conveyed between the heating and pressure rollers 1 and 2 and the toner image T is fixed by the surface temperature of the rollers 1 and 2, whereafter the paper P is discharged outwardly of the apparatus while being nipped by and between paper discharge rollers 20 and 21. On the discharge outlet side of the heating roller, a plurality of separating pawls 5 for positively separating the plain paper P from the heating roller are provided along the axial direction of the roller and in contact with the surface of the roller.

Also, on the discharge outlet side of the pressure roller 2, a separating pawl 5*a* is provided in contact with the surface of the roller 2.

The separating pawls 5 are held by a support plate 18 spaced apart from a casing member 16, and the separating pawl 5*a* also is held by a support plate 18*a* spaced apart from a casing member 17 below the fixing device. The casing member 17 is spaced apart from the reflecting plate 9 and insulating cover 10 of the pressure roller 2 and covers these.

The reflecting plates 7 and 9 should preferably be a metal having a lustrous surface such as surface-polished aluminum or copper plate or an iron plate having the surface thereof plated with Cr. The shape of the reflecting plates 7 and 9 should preferably be one having such a curvature that they are concentric with the peripheral surfaces of the rollers because such shape is high in insulating effect and reflecting effect, and the thickness of these reflecting plates should preferably be relatively small.

The insulating covers 8 and 10 should preferably be composed or compositely composed of glass wool, rock wool, ceramic fiber or a foamed material such as phenol foam or epoxy foam.

The insulating covers and reflecting plates will later be described in greater detail with reference to FIGS. 14 and 15.

Figure 1:
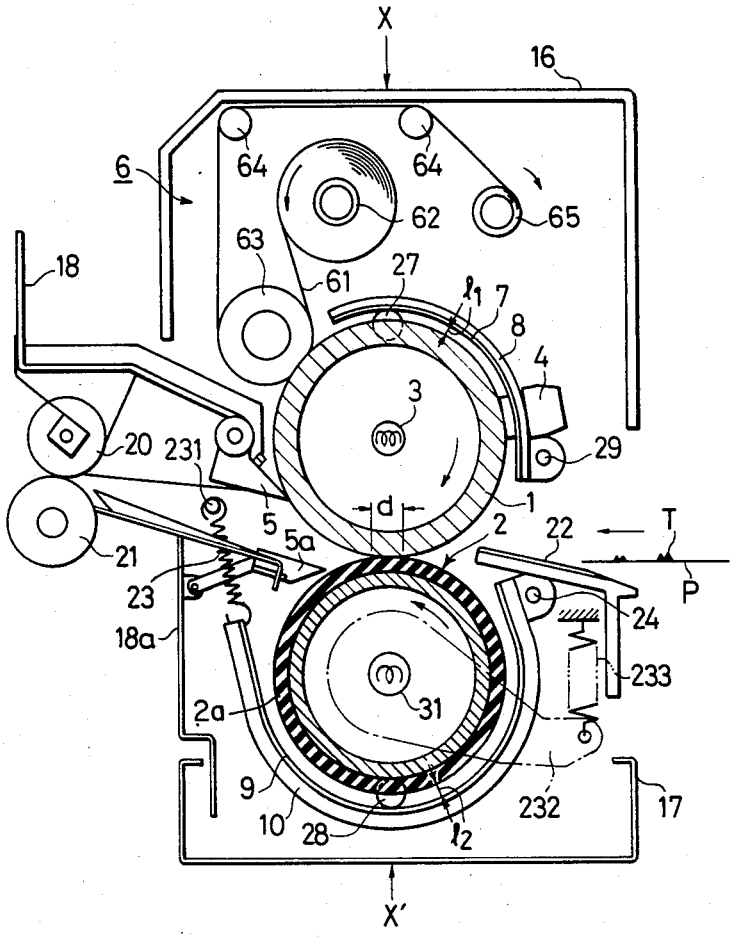
FIG. 1 illustrates an embodiment of the present invention.
Figure 3:
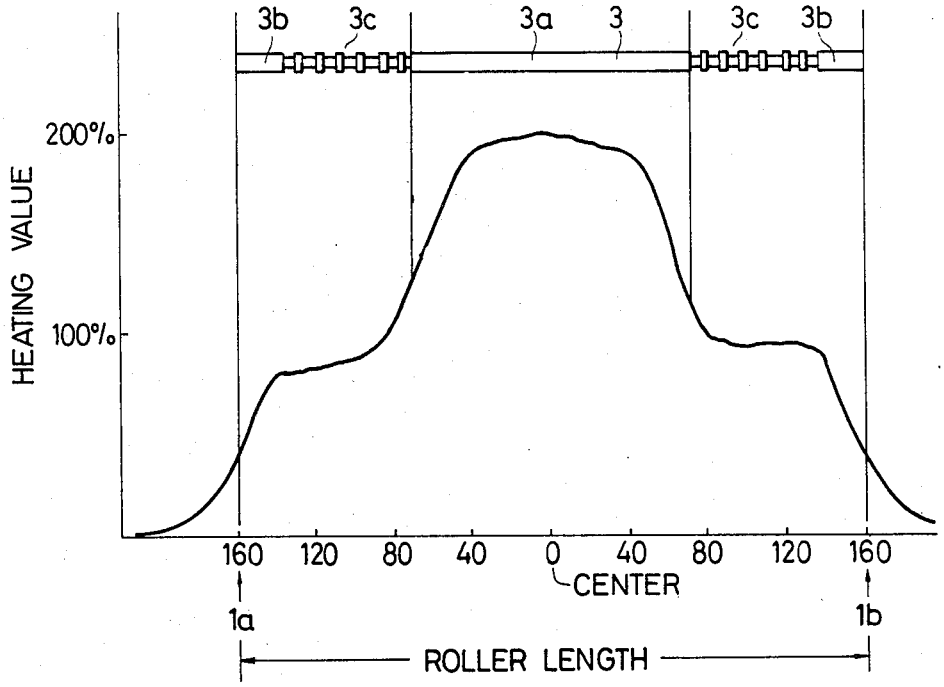
FIG. 3 is a graph showing the heating distribution of the 200% heater of the fixing device.

Reference is now had to FIG. 2 which shows a cross-section of the fixing device taken on the plane X–X′ of FIG. 1 and to FIG. 3 to describe the construction of the heating roller 1 in detail.

Reference numerals 111 and 111*a* designate heat-resistant sleeves fitted on rotary shafts 11 and 11*a*, respectively, forming the opposite ends of the heating roller 1. The sleeves 111 and 111*a* are in contact with bearings 12 and 12*a*, respectively, mounted on the frame members 13 and 13*a*, respectively, of the fixing device. Denoted by 14 and 14*a* are heat-resistant gears fitted on the rotary shafts 11 and 11*a*, respectively, of the heating roller 1. The heat-resistant gear 14*a* is in mesh engagement with a drive transmitting gear 25 so that the drive force from the drive source M is transmitted thereto, and is rotated with the heating roller 1 by the drive source. A gear 261 of a manual knob 26 is in mesh engagement with the heat-resistant gear 14 and manual drive force is transmitted thereto. The manual knob 26 may be turned by the operator when it is desired to manually rotate the heating roller 1 as when paper jam is dealt with.

Since the heat-resistant gears 14 and 14*a* are formed of a heat-intercepting insulating material, the dissipation of heat from the heating roller 1 through the gears 14 and 14*a* to other drive transmitting members such as gears is substantially prevented. These gears 14 and 14*a* improve the heat-retaining characteristic of the heating roller 1 at the ends thereof.

The heat-resistant sleeves 111 and 111*a* also are formed of a heat-intercepting insulating material to prevent the heat loss resulting from the transfer of heat from the ends of the heating roller 1 to the bearings 12, 12*a* and frame members 13, 13*a*. Accordingly, the heat loss from the ends of the heating roller 1 can be reduced more than heretofore by the heat-resistant gears 14 and 14*a*, and the addition of the heat-resistant sleeves 111 and 111*a* can greatly reduce or almost eliminate said heat loss.

Generally, a number of other drive transmitting members are often operatively associated with the heat-resistant gears 14 and 14*a*. Consequently, most of the heat loss has heretofore occurred in such a drive system. The above-described embodiment can reduce or eliminate the heat loss to the drive system and can therefore highly improve the heat efficiency and reduce the power consumption. Also, in the above-described embodiment, the heat-resistant sleeves 111 and 111*a* are employed in addition to the heat-resistant gears 14 and 14*a* and thus, the heat loss from the roller ends to the frame members 13 and 13*a* can be prevented and the heat efficiency can be further improved. The above-described embodiment is provided at the opposite ends of the heating roller 1, but it may have an insulating region at least between that side which receives the drive force of the member transmitting the drive force to the roller 1 and the roller 1. The heat-resistant sleeves should preferably be formed of a heat-intercepting material such as polyimide, polyamideimide, polyamide, PPS (polyphenylene sulfide), PBT (polybutylene terephthalate) resin or phenol resin or a mixture thereof. The gears 14 and 14*a* should preferably be formed of a heat-resistant material of good heat-intercepting property such as polyimide, polyamideimide, PPS, denatured phenol or tetrafluoroethylene with a reinforcing filler added thereto.

As described above, the heating roller 1 is thermally insulated from the apparatus body and frame members 13 and 13*a* by the heat-resistant sleeves 111 and 111*a* and heat-resistant gears 14 and 14*a* and thus, the heat loss therethrough is greatly reduced.

Centrally in the hollow of the heating roller 1, there is a heater 3 provided axially of the roller. This heater 3 is important to the present invention. As is shown in FIG. 3, the heater 3 has a heating area of the same length as the heat-treatable surface of the heating roller (the length from the end 1*a* to the end 1*b*; in the present example, 320 mm). The heating area of the heater 3, as shown in the upper part of FIG. 3, has in the central portion of the heating roller a continuous heating zone 3*a* of a length of 150 mm (75 mm each on the left and right) bilaterally symmetrically about the center thereof. The heater 3 also has a heating area of a full length of 320 mm, and has continuous heating zones 3*b* of a length of 22 mm at the opposite ends thereof, and low heating areas 3*c* in which a plurality of low heating portions are provided exist between the heating zones 3*a* and 3*b*.

The heating value of the heater 3, as indicated by the curve in FIG. 3, is 40–200% (with the low heating portions as the reference) corresponding to the heating zones and heating portions and as a whole, it presents a curve convex in the central portion thereof.

The use of such a heater 3 causes heat transfer from the central portion toward the ends of the heating roller 1 and the entire surface of the heating roller 1 exhibits a substantially uniform temperature distribution because the ends of the roller are treated for preventing heat radiation.

When the fixing action is effected in such state, even if the temperature of the heating roller is reduced by the toner image and the support member such as plain paper, supply of heat is effected rapidly and therefore, no abnormal temperature rise occurs in the end portions of the roller and a substantially uniform temperature distribution is obtained throughout the roller. Further, the surface temperature of the heating roller can be maintained at a temperature necessary for fixation by the heater 3.

Figure 4:
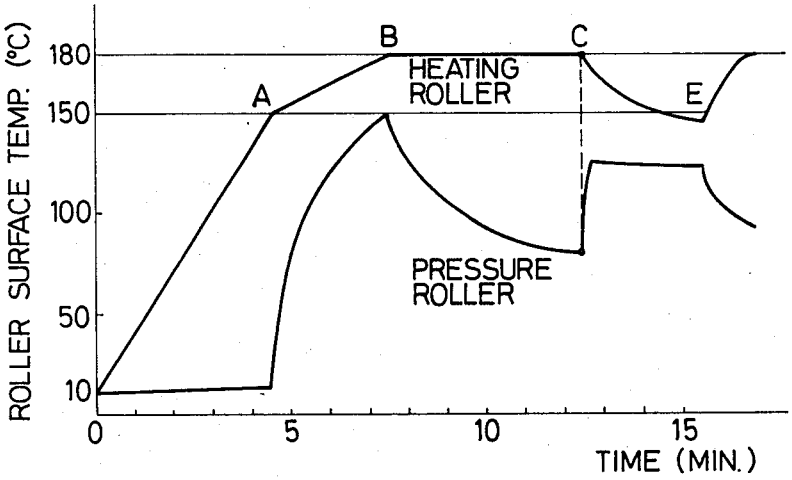
FIG. 4 is a graph showing the variation in roller surface temperature for time.
Figure 13:
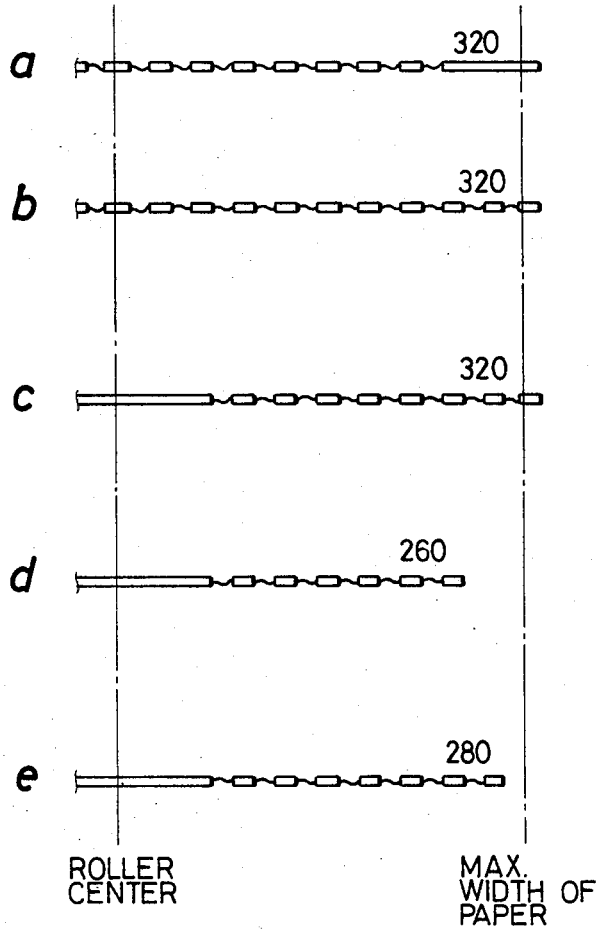
FIG. 13 comparatively illustrates the heaters of the present invention and the heaters of the prior art.

Another embodiment of the heater 3 and the technique thereof will later be described with reference to FIGS. 9, 10 and 13.

Where a heating roller and a pressure rubber roller both having an internal heating source are employed as in the heating-fixing device described in connection with FIGS. 1–3, the surface temperature of each roller generally changes in conformity with mode changes (the wait up to point B, the stand-by at points B–C, and the fixation at points C–E) as shown in FIG. 4.

When the power source is switched on at time t=0, the heater 3 and heater 31 are turned on. The surface temperature of the heating roller rises as shown and when it reaches 150° C. (point A), the two rollers 1 and 2, so far stopped from rotation, start to rotate while keeping pressure contact therebetween and the surface temperature of the pressure roller also rises sharply.

When the surface temperature of the heating roller reaches 180° (point B), there is provided a condition in which fixation is possible, and the two rollers 1 and 2 are stopped from rotation. The heating roller 1 is then maintained at a surface temperature of about 180° C. by control means, not shown. On the other hand, the surface temperature of the pressure roller 2 drops because the supply of heat from the fixing roller becomes null. In about 5 minutes after the condition in which fixation is possible (point C), the temperature of the pressure roller becomes minimum and thereafter, the temperature thereof is gradually increased by the heat from the heater 31 therewithin. Therefore, the fixing capability at point C is lowest. Accordingly, if continuous copying is effected at this point C, there will be obtained very preferable fixing efficiency. In FIG. 4, the temperature change when continuous copying of 99 sheets has been effected at point C is depicted including the termination of the copying of 99 sheets (point E).

In the fixing device of the above-described construction, the heating roller 1 used was a roller having an outer diameter of 60 mm and comprising a mandrel of aluminum having a thickness of 7 mm and having the surface thereof covered with a PFA coating of a thickness of 35 μm and the pressure roller 2 used was a roller having an outer diameter of 60 mm and comprising a mandrel of stainless steel having a diameter of 50 mm and covered with a coating of heat-vulcanized silicon rubber of a thickness of 5 mm.

A halogen heater of 650 W is used as the heater 3 in the heating roller and is normally turned on, and a sheath heater of 70 W is used as the heater 31 in the pressure roller and is turned on except during copying.

The area d of pressure contact between the two rollers was 11 mm and the surface temperature of the heating roller was 180° C.

An example of comparison will hereinafter be described with the foregoing embodiment exhibiting the tendency of FIG. 4 as the basis.

The result of the experiment shown below was obtained under the following common conditions between the points C to E. That is, under an environment of 10° C., solid black of 24 mm was formed on sheets of paper of A3 size at a copy speed of 405 mm/sec. (35 sheets of paper of A3 size per minute) and at a weight of 80 g/m$^2$ and the 1st, 6th, 11th, 16th, 21st, 31st, 41st, 51st, 61st, 71st, 81st and 91st sheets, total 12 sheets, were chosen from among 99 continuous copies and nine locations for each sheet were subjected to the experiment. The evaluation of the fixing efficiency at 9 locations on each of 12 sheets, total 108 locations, was expressed in numerical values by rubbing those locations ten times with a pressure of 40 g/cm$^2$ by the use of Kojin Wiper (tradename for a throw-away paper wiper, produced by Kojin K. K., paperwess) and measuring the density difference before the rubbing by means of a Macbeth reflection density meter. That is, $$\Delta D = \frac{D - DA}{D} \times 100(\%)$$

where

D: reflection density before the solid black image is rubbed (the image density is adjusted so that $1.0 \leqq D \leqq 1.1$)

DA: reflection density after the solid black image was rubbed

ΔD: rate of density reduction.

The above-mentioned 9 locations are (three points at the opposite ends and center of the roller) x (three forward, middle and rearward points with respect to the direction in which the paper is fed).

The consitutional factors of each fixing device will be shown in Table 1 below.

TABLE 1

| | Fixing device No. | | | | | | |
|---|---|---|---|---|---|---|---|
| Construction | 1 | 2 | 3 | 4 | 5 | 6 | 7 |
| Heater | Uniform | ← | ← → | → | Uniform | Heater having characteristic shown in FIG. 3 (or the length is shorter than maximum paper passage width) | Uniform |
| Heat radiation preventing member + reflecting member | Absent | Present | ← | ← → | → | Present | Absent |
| Adiabatic material (Thermal barrier) | | | | | | | |
| Between roller and frame | Absent | Absent | Present | Absent | Present | Present | Absent |
| Between | Ab- | ← → | Ab- | Pre- | ← | → | Pre- |

TABLE 1-continued

| Construction | Fixing device No. 1 | 2 | 3 | 4 | 5 | 6 | 7 |
|---|---|---|---|---|---|---|---|
| roller and drive system | sent | | sent | sent | | | sent |

A uniform winding heater of a heating length of 330 mm was used as the uniform heater of each of fixing devices Nos. 1–5. The 200% heater of fixing device No. 6 is a heater in which the heating distribution in the central portion as shown in FIG. 3 is great. The use of a uniform winding heater of a heating length of 297 mm or less (namely, a heater of a length less than the maximum paper passage width, preferably, a heater shorter by 20 mm–80 mm than the maximum paper passage width) instead of the 200 % heater resulted in an effect substantially equivalent to what will be described later.

Table 2 below shows the result of fixing efficiency of the respective fixing devices, and the numbers therein indicate in how many locations (out of 12 sheets×9 locations, i.e. 108 locations) the rate of density reduction is greater than predetermined percentages (15, 10 and 5%).

TABLE 2

| Rate of density reduction | Fixing device No. 1 | 2 | 3 | 4 | 5 | 6 | 7 |
|---|---|---|---|---|---|---|---|
| 15% or more | 83 | 21 | 15 | 10 | 2 | 0 | 15 |
| 10% or more | 100 | 31 | 23 | 14 | 3 | 0 | 26 |
| 5% or more | 108 | 63 | 47 | 19 | 8 | 1 | 45 |

As is apparent from Table 2, preferable conditions are added to fixing device No. 1 to fixing device No. 6 and this leads to better fixing efficiency.

A particularly remarkable difference is found in:

① the comparison between No. 1 and No. 2 and between No. 4 and No. 7;

② the comparison between No. 4 and No. 5; and

③ the comparison between No. 5 and No. 6.

① is the effect resulting from the provision of the heat radiation preventing member and the reflecting member, ② is the effect resulting from the thermal barrier being established, and ③ is the effect resulting from the heating distribution of the heater 3. From the comparison between fixing device No. 3 and fixing device No. 4, it is understood that No. 4, i.e. preventing the heat loss of the drive system, is more effective. Also, from the comparison among fixing device No. 2, fixing device No. 3 and fixing device No. 4, the effect resulting from the provision of the thermal barrier is confirmed. Particularly in No. 6, the establishment of the thermal barrier and the heat distribution of the heater provide a further effect, and this is very important and effective in the system which effects high-speed fixation.

TABLE 3

| Fixing device No. | Wait time Minute | Second |
|---|---|---|
| 1 | 8 | 13 |
| 2 | 7 | 45 |
| 3 | 7 | 34 |
| 4 | 7 | 21 |
| 5 | 6 | 58 |
| 6 | 6 | 45 |
| 7 | 7 | 35 |

Table 3 above shows the result of comparison of the wait time (the time from after the closing of the main switch until fixation becomes possible) in these fixing devices. Prevention of the heat loss becomes greater from fixing device No. 1 toward fixing device No. 6 and therefore, the wait time is likewise reduced.

That is, power saving can be reliably achieved. Also, the time required until the temperature distribution over the full length of the roller becomes stable and uniform is almost unmeasurable in f device No. 1, whereas it can be rapidly reduced in No. 7 or No. 2 to No. 6.

Figure 5:
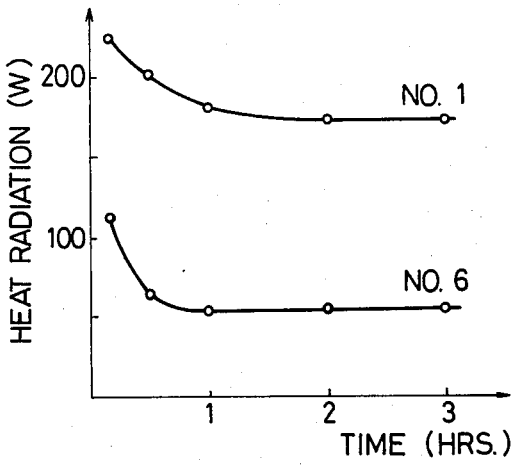
FIG. 5 illustrates the variation with time in amount of radiant heat in fixing device No. 1 and fixing device No. 6.

FIG. 5 shows the variation in amount of heat radiation with time during the stand-by of fixing device No. 1 and fixing device No. 6. As is apparent from this Figure, fixing device No. 1 becomes stabilized to the amount of discharge of about 170 W in 1.5 hours, whereas fixing device No. 6 becomes stabilized to the amount of discharge of about 50 W within one hour.

In this manner, it is rendered easier to maintain the surface temperature of the heating-fixing roller or the like uniform by providing heating means in which the heating value in the central portion thereof is greater or by using heating means which makes the area occupied by the portion providing the heating value smaller than the maximum area through which the recording medium used passes. One reason therefor is that the heat used for the recording medium can be supplied on the spot and the temperature rise in the area through which the recording medium does not pass or in the end areas can be alleviated. Such heating means is particularly effective for the fixing device of the present embodiment in which the loss of the heat or the like dissipated from the end areas to other drive system or support frame is reduced.

The heat radiation preventing member + the reflecting member in the above-described construction means the reflecting plates 7, 9 and covers 8, 10 in the embodiment of FIG. 2, and the presence thereof is indicated. Also, the thermal barrier in the above-described construction signifies means capable of preventing heat conduction (for example, a member formed of a heat-resistant, heat-intercepting material), and the presence thereof between the roller and the frame member and/or between the roller and the drive system is indicated.

Fixing device No. 7 is one which has the thermal barrier between the roller and the drive system as in the previously described embodiment, and exhibits a more excellent effect than the other constructions, that is, prevents the heat loss and improves the fixativeness.

Summing up, the disadvantages peculiar to the prior art can be overcome if means for preventing the heat loss from the end portions of the roller is provided for the roller heated by external or internal heating means and use is made of external or internal heating means in which the heating value is greater in the central portion than in the end portions of the roller. Likewise, the disadvantages peculiar to the prior art can be overcome if instead of such heating means, use is made of heating means having a heating area less than the maximum length of the support member carrying thereon the toner image used with respect to the lengthwise direction of the roller and exhibiting a substantially uniform heating value.

As a construction which is more excellent in effect than what has been described above, there is one in which means for utilizing the heat wastefully emitted from the surface of the roller for the purposes of maintaining the temperature and heating the roller is added.

Said effect is more enhanced as the insulating effect at the ends of the roller is higher.

Said effect includes the power saving, the reduction of the wait time and the enhancement and, uniform maintainance of the fixing efficiency, and the above-described device exhibited a remarkably excellent effect in the continuous heating treatment.

The previously described heat-resistant gears 14 and 14*a* are mounted on the heating roller itself and are formed of a heat-resistant, insulating material which exhibits an excellent insulating effect. These gears are of a novel construction which has not been available heretofore. In the gears of the prior art, a thin layer of insulating material is simply interposed between the gears and the roller shaft and screws or the like are used to couple them together, and this has led to a low insulating effect as well as a low reliability in terms of durability and strength.

Figure 6:
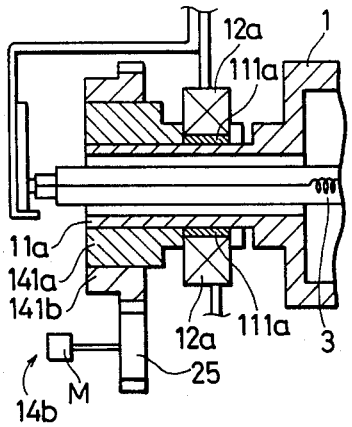
FIG. 6 is an enlarged view of the roller end portion in another embodiment of the present invention.
Figure 7:
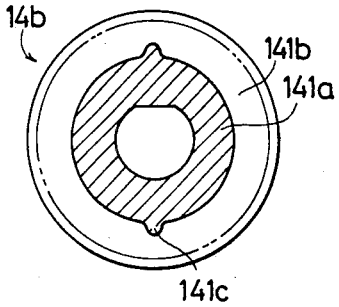
FIG. 7 is an enlarged view of the gear of FIG. 6.
Figure 8:
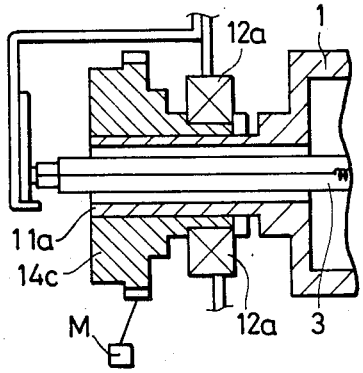
FIG. 8 is an enlarged view of the roller end portion in still another embodiment of the present invention.

FIGS. 6, 7 and 8 show a single gear whose durability and strength have been improved and which can be used as the heat loss preventing member of the present invention shown in FIGS. 1 and 2.

In FIGS. 6 and 7, the gear 14*b* is of a two-layer construction, that is, it has an inner layer 141*a* including the entire surface to be mounted on the roller shaft and formed of heat-intercepting, insulating resin, and an outer layer 141*b* constituting an outer gear portion and formed of a metal. A metal which is excellent in mechanical strength and low in cost is preferred as the metal of the outer layer 141*b* and in the present example, iron is employed. This gear 14*b* has its inner and outer layers formed integrally by extrusion molding. The outer layer 141*b* of the gear 14*b* is in mesh engagement with other drive transmitting gear 25 and receives the drive force from the drive source M. The gear 14*b* is constructed as shown in FIG. 7. A groove 141*c* is formed in the outer layer 141*b* having a tooth surface and formed of a metal, whereby the inner layer 141*a* formed of heat-resistant resin is molded. Consequently, this gear is excellent in strength and never creates peeling-off between the metallic portion and the resin portion even when it transmits a high torque. Providing such an engaging portion to increase the strength of the heat-resistant resin portion and of the metallic portion is preferable.

This gear 14*b* is good in durability and strength, low in production cost and has insulating characteristics and therefore highly practical.

The gear 14*c* shown in FIG. 8 is of a configuration in which a member such as the aforementioned sleeve 111*a* formed of an insulating material is made integral with a heat-resistant drive-transmitting member such as the gear 14*a* (see FIG. 2), and all the gear 111*a* is formed of an insulating material.

By so providing an integral heat-intercepting member in the portion supporting the heating roller 1 and the portion directly driving the heating roller 1, not only the aforementioned effect of the present invention is more enhanced, but also the number of parts can be reduced to achieve reduced cost and ease of manufacture.

As another example of the gear, there is one in which a thin metal layer is provided inside the inner layer of the gear 14*b* shown in FIG. 6. This slightly increases the heat loss but can achieve enhanced strength. A gear in which the inner layer of the gear 14*b* of FIG. 6 is made integral with the sleeve 111*a* (See FIG. 16) is excellent in insulating effect because the thickness of the adiabatic layer in the gear portion is greater than that of the insulating layer between the bearing 12*a* and the roller shaft 11*a*, and also has the aforementioned advantages. Conversely, the sleeve 111*a* instead of the gear may be elongated and the gear may be mounted through the sleeve 111*a*.

Where a metal is employed for the gear, it is preferable to space the gear apart from the bearing 12*a* to thereby prevent any heat loss resulting from the conducted heat.

Figure 9:
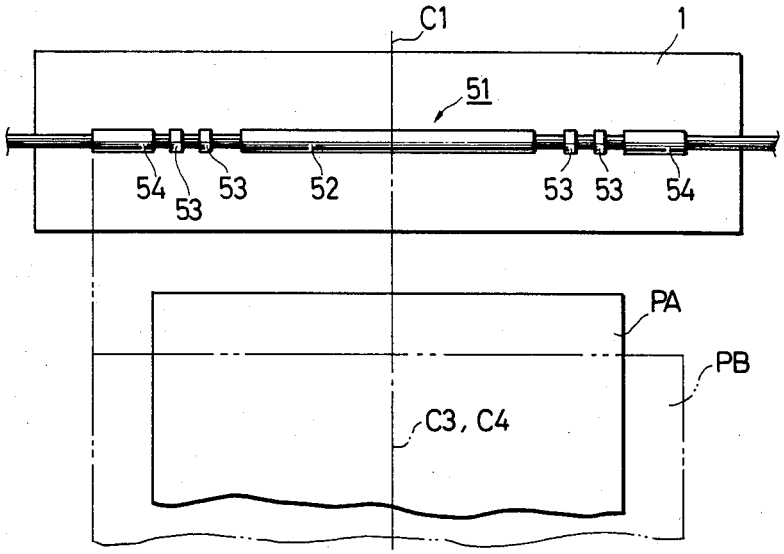
FIGS. 9 and 10 are model views showing the positional correspondence relation between the heater of the present invention and paper size.
Figure 10:
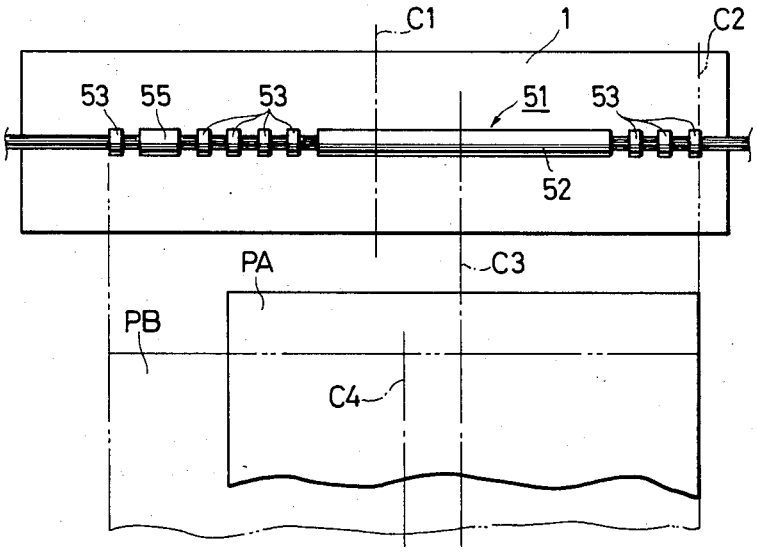

FIGS. 9 and 10 illustrate heating means particularly effective for the embodiment in which the heating roller 1 is brought into a thermally floated condition by the aforedescribed numerous constructions. FIG. 9 shows an example of the center standard conveyance in which the recording medium used is conveyed with the center of the width thereof with respect to the direction of conveyance of the recording medium being coincident with the center of the heating means, and FIG. 10 shows an example of the one side standard conveynace in which the recording medium used is conveyed with one side edge thereof with respect to the direction of conveyance of the recording medium being coincident with one end of the heating means.

In these Figures, C1 designates the center line with respect to the lengthwise direction of the heating roller 1 (in FIG. 3, it is the standard line of the center standard conveyance), C2 denotes the standard line of the one side standard conveyance, C3 designates the center line of the feed width of a recording medium PA of JIS A series size, and C4 denotes the center line of the feed width of a recording medium PB of JIS B series size.

In FIG. 9, a halogen lamp 51 is provided bilaterally symmetrically in the axial direction of the roller with respect to the center line C1. It is to be understood that conveyance of the recording medium is effected so that the center line C1 and the center lines C3 and C4 are on a straight line, and that the feed width is smaller for the recording medium PA than for the recording medium PB. Designated by 52, 53 and 54 are the light-emitting portions of the halogen lamp 51. The light-emitting portion 52 is longest and provides a maximum amount of heat to the central portion of the roller. The length of the light-emitting portion 52 is smaller than the width of the recording medium PA, i.e. about 60% of said width. The light-emitting portions 54 are provided in the portions corresponding to the difference between the width of the recording medium PA and the width of the recording medium PB. The light-emitting portions 53 are provided between the light-emitting portins 52 and 54 and are shortest and make up for the heating distribution between the light-emitting portions 52 and 54. No light-emitting portion is provided in the area of the roller through which the paper does not pass (that portion of the roller through which even a recording medium of the largest size does not pass). Again in this case, the heating distribution is as shown in FIG. 3.

By the above-described halogen lamp 51 being so provided, the amount of heat required during the center standard conveyance can be imparted and the temperature rise in the end portions of the fixing roller can be prevented moderately. Accordingly, the thermally floated condition of the heating roller can be further stabilized and thus, a stable condition can be achieved even in the continuous fixation during the center standard conveyance. Also, the amount of heat by the temperature control for obtaining such fixation temperature can be reduced more than heretofore and this leads to power saving.

In FIG. 10 which shows the aforementioned one side standard conveyance, the light-emitting portion 52 is provided bilaterally symmetrically with respect to the center line C3 of the usually often used recording medium (for example, of A4 size) PA. In this Figure, the center lines C1, C3 and C4 are not on a straight line and the standard line C2 is located at one end portion of the fixing roller 1. Designated by 55 is a light-emitting portion which is longer than the light-emitting portions 53 and provided in the portion corresponding to the difference in width between the recording mediums PA and PB. The light-emitting portions 53 are provided equidistantly in the portion of the maximum width of the recording medium except for the light-emitting portions 52 and 55.

Accordingly, the heating distribution is such that the convexity (the peak) of the highest portion lies more toward the standard line C2 than the center line C1 of the roller, and a moderate convexity is formed in a portion corresponding to the light-emitting portion 55. Again in this example, no light-emitting portion is provided in the portion of the roller through which the recording medium does not pass.

With the above-described construction, the thermally floated condition of the heating roller can be made more effective and even during the one side standard conveyance, there can be achieved stable fixing efficiency which is not affected by the size of the recording medium. Also, temperature rise in the end portions of the fixing roller 1 and the area thereof through which the recording medium does not pass can be prevented and temperature fall in the end portions of the fixing roller can also be prevented and therefore, stable fixing efficiency of the fixing roller can be maintained for a long period of time.

Although FIGS. 9 and 10 have been described with respect only to the fixing roller 1, the gist of the present embodiment is also applicable to the pressure roller 2 and the hot roller of a dry silver type recording apparatus or the like in which the image is stabilized by heating of other means, whereby heat loss can be prevented as previously described.

Accordingly, if the heating roller is brought into a more thermally floated condition, the amount of heat, the prevention of heat loss, the enhancement of the fixing efficiency, the speed of the thermal stabilization of the heating roller, etc. can be made more reliable.

Figure 11:
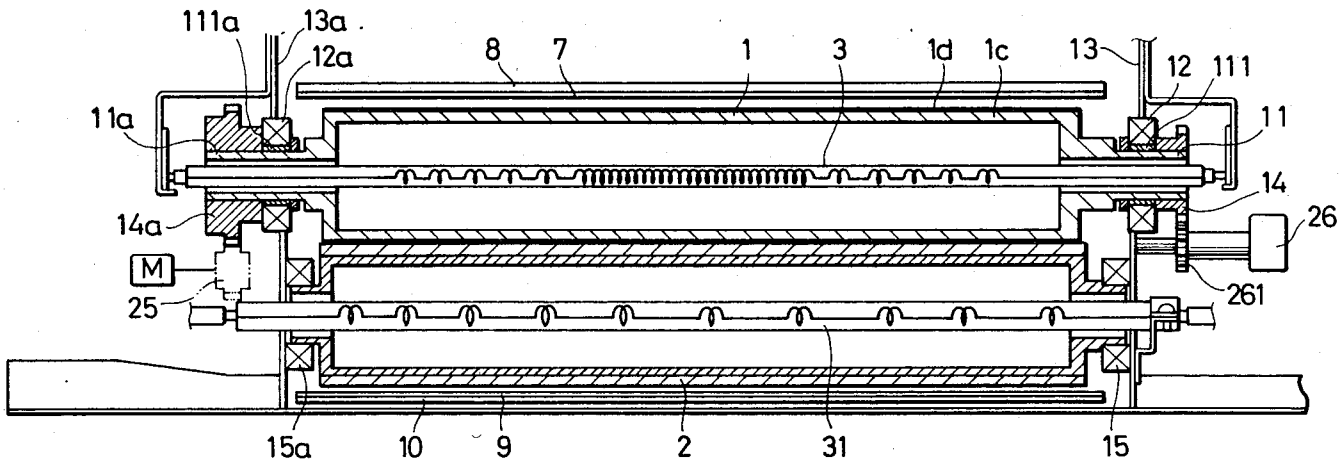
FIGS. 11 and 12 are cross-sectional views of further embodiments of the present invention.
Figure 12:
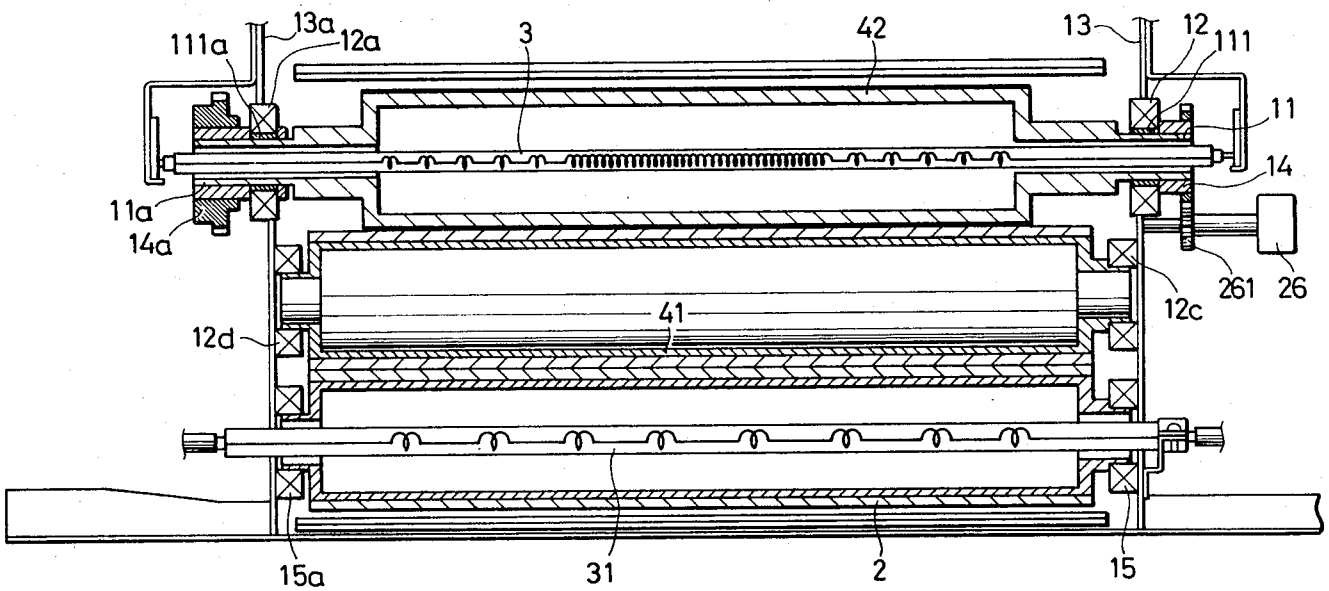

FIGS. 11 and 12 show further embodiments of the present invention. These embodiments are common to each other in that the roller contacting the toner image has a layer of heat-resistant elastic material on the surface thereof. In the other points, these embodiment are similar to the embodiment shown in FIGS. 1 and 2 therefore, only the differences of these embodiments from the embodiment of FIGS. 1 and 2 will hereinafter be described.

Referring to FIG. 11, the heating roller 1 is provided on that side which contacts the toner image. The heating roller 1 has a thin (2 mm or less thick) heat-resistant elastic layer 1*d* on the surface of a metallic roller 1*c*. The heater 3 in the heating roller 1 has a heating area within the maximum width of the support member used (with respect to the axial direction of the roller) and in this area, the heating value is greater in the central portion than in the opposite end portions thereof. At the ends of the heating roller 1, an insulating material for preventing heat radiation is provided on the gears 14, 14*a* and sleeves 111, 111*a*. The reflecting plates 7, 9 and insulating covers 8, 10 are similar to those shown in FIGS. 1 and 2. The present embodiment, as compared with the previous embodiment, employs as the heating roller a roller having a thin heat-resistant elastic layer on the outer peripheral surface thereof and this, coupled with the above-described point, can further enhance the fixing efficiency. The thin heat-resistant elastic layer may effective be formed of heat-vulcanized silicon rubber, room-temperature-vulcanized vulcanized silicon rubber, fluorosilicon rubber, fluorine rubber or epichlorohydrine rubber or any of these rubbers mixed with metals or carbon black as a filler, the metals including metals oxide such as titanium oxide, nickel oxide, cobalt oxide and titanium white having the surface thereof plated.

The specific numerical data of the present embodiment will now be described.

In the fixing device of the above-described construction, the heating roller 1 used was a roller having an outer diameter of 60 mm and comprising an aluminum mandrel of a thickness of 7 mm covered with a layer of heat-vulcanized silicon rubber of a thickness of 0.5 mm, and the pressure roller 2 used was a roller having an outer diameter of 60 mm and comprising a stainless steel mandrel of 50 mm diameter covered with a layer of heat-vulcanized silicon rubber of a thickness of 5 mm.

As the heater 3 in the heating roller, a halogen heater of 650 W was used and normally turned on, and as the heater 31 in the pressure roller, a sheath heater of 70 W was used and turned on except during copying.

The area d of pressure contact between the two rollers was 10 mm and the surface temperature of the heating roller was 180° C.

With the fixing device of such numerical data as the basis, fixing devices Nos. 1–7 shown in Table 4 below were prepared and compared by the use of the evaluation method using the Macbeth reflection density meter.

TABLE 4

| | Fixing device No. | | | | | | |
|---|---|---|---|---|---|---|---|
| Construction | 1 | 2 | 3 | 4 | 5 | 6 | 7 |
| Material of roller | TF | SI | SI | SI | SI | SI | SI |
| Heater | a | a | b | c | d | e | d |
| Thermal float | Absent | Absent | Present | Present | Present | Present | Present |
| Reflecting member and heat radiation preventing member | Absent | Absent | Absent | Absent | Absent | Absent | Present |

In Table 4 above, TF (fixing device No. 1) expressed as the material of the roller shows that a roller having an outer diameter of 60 mm and comprising an aluminum mandrel of a thickness of 7 mm covered with a layer of PFA (Teflon) of a thickness of 35 μm was used as the heating roller 1.

Also, SI (fixing devices Nos. 2–7) shows that a roller covered with the heat-vulcanized silicon rubber was used as the heating roller. In fixing device No. 6, use was made of a roller of the external heating type as shown in FIG. 5.

The heater used was the one having the light-emitting portions as shown in FIGS. 13*a–e*. In FIG. 13, a shows a heater of great end heating value effective for a fixing device in which the escape of heat from the roller ends is great as is conventional, b shows a heater of uniform heating value throughout the length thereof, and c–e show heaters of great heating value in the central portion thereof which are particularly effective for the fixing device of the present invention in which the heat loss from the opposite end portions is minimized.

As regards the presence or absence of thermal float, a construction in which the heating roller is thermally floated by heat-resistant gears and heat-resistant sleeves formed of a heat-intercepting material as previously described is expressed as having thermal float.

A construction in which, as is conventional, gears formed of a metal are used and/or the roller shaft is in direct contact with the bearing without the intermediary of heat-resistant sleeves is expressed as having no thermal float.

The presence or absence of the reflecting member and heat radiation preventing member represents the presence or absence of the aforementioned reflecting plates 7, 9 and covers 8, 10.

Table 5 below shows the result of the fixing efficiency of the respective fixing devices, and the numbers therein indicate in how many locations (out of 12 sheets×9 locations=108 locations) the rate of density reduction exceeds the predetermined (15, 10 or 5) percent.

TABLE 5

| Rate of density reduction | Fixing device No. | | | | | | |
|---|---|---|---|---|---|---|---|
| | 1 | 2 | 3 | 4 | 5 | 6 | 7 |
| 15% or more | 103 | 22 | 5 | 0 | 0 | 0 | 0 |
| 10% or more | 108 | 30 | 16 | 14 | 0 | 11 | 0 |
| 5% or more | 108 | 41 | 20 | 15 | 2 | 27 | 0 |

As is apparent from Table 5, there is a remarkable difference between fixing device No. 1 and fixing device No. 2.

This is attributable to the difference between a Teflon roller and a silicon rubber roller (an elastic roller), and it will be seen that the silicon rubber is better in fixing efficiency. The reason therefor would be that when an unfixed toner image concavo-convexly and electrostatically attracted to copy paper is to be fixed, if a roller which is almost rigid such as a Teflon roller is used, pressure is applied only to the toner in the convex portions and not to the toner in the concave portions, thus resulting in unsatisfactory fixation. On the other hand, in the case of a silicon rubber roller, it seems that the elasticity of the rubber causes uniform pressure to be applied to the toner both in the convex and concave portions, thus resulting in good fixing efficiency.

However, in the case of the construction of fixing device No. 2, wrinkles were created in the first several copies after the apparatus was left for stand-by under high humidity.

As the copying progresses, wrinkling disappears, but in fact, wrinkles were again created in the first several copies after the second stand-by.

The wrinkles are caused by the following reason. Since the heat radiation to the end portions is great during stand-by, the temperature of the end portions becomes lower than the temperature of the central portion (180° C. in the central portion and 163° C. in the end portions) and the roller is deformed into a barrel shape (having a larger diameter in the central portion than in the end portions) due to the difference in thermal expansion and therefore, under high humidity, copy paper absorbs the humidity and becomes corrugated and thus wrinkled. The wrinkling disappears as continuous paper feeding progresses, and this seems to be attributable to the fact that the heater designed to heat intensely at the end portions thereof is almost fully turned on and therefore the temperature of the end portions of the roller is increased, whereby the roller is deformed into a hand-drum shape (an inverted crown shape). Accordingly, to prevent the wrinkling, it is necessary to intensify the heating in the end portions as compared with the central portion, but this is a useless effort because the escape of heat from the end portions becomes further greater.

Also, there is found a remarkable difference between fixing device No. 2 and fixing device No. 3. This is the effect obtained when the heating roller is thermally floated.

In the construction of fixing device No. 3, sixteen points whereat the rate of density reduction was 10% or more were all in the central portion. This is attributable to the fact that because the escape of heat from the end portions is small, heat is accumulated in the end portions as the copying progresses and due to that heat, the thermal expansion of the end portions of the pressure roller also becomes great and the diameter of the end portions thereof becomes greater than that of the central portion thereof and thus the pressure distribution between the two rollers becomes higher in the end portions, resulting in weak fixation in the central portion. Fixing device No. 4 is one in which paper feeding test was carried out with the heating distribution of the heater more intensified in the central portion, and this fixing device obtained a better result than fixing device No. 3. However, again in fixing device No. 4, fourteen points whereat the rate of density reduction was 10% or more were all in the central portion. This is attributable to the fact that the light-emitting length of the heater is 320 mm which is long as compared with the paper passage width of 297 mm and therefore the extra heat in each end of a length of 11.5 mm is accumulated, thus resulting in a similar phenomenon although slighter than in fixing device No. 3.

With the construction of fixing device No. 5 in which the light-emitting length of the heater was reduced to 260 mm, there was obtained a very good result. Also, in the constructions of fixing devices Nos. 3–5, the temperature distribution in the axial direction of the roller during stand-by was very uniform, say, 180±0.5° C. within the paper passage width (within the range of 297 mm) and uniform and good fixing efficiency was obtained even for single copying, and wrinkling of copy paper did not occur at all even under high humidity.

Also, with fixing device No. 7 in which the reflecting member and heat radiation preventing member were additionally applied to the construction of fixing device No. 5, there was obtained a very good result. Even when the electric power of the heater was dropped to 560 W, the rate of density reduction was within 5%. On the other hand, in the construction of fixing device No. 5, when paper was fed with the electric power of 560 W as in the case of fixing device No. 7, the rate of density reduction was 15% or more at 0 point, 10% or more at 12 points and 5% or more at 21 points.

Fixing device No. 6 is an embodiment of the external heating type which uses a silicon rubber roller of a relatively great wall thickness as the fixing roller. The construction of this fixing device will hereinafter be described briefly by reference to FIG. 12.

In FIG. 12, reference numeral 41 designates a fixing roller adapted to contact the toner image. The pressure roller 2 is urged against the fixing roller 41 during at least fixation. The fixing roller 41 is a roller of an outer diameter of 60 mm comprising a mandrel of stainless steel covered with a coating layer of heat-vulcanized silicon rubber having a thickness of 5 mm.

The pressure roller 2 is a roller having an outer diameter of 60 mm and comprising a mandrel of stainless steel of 50 mm in diameter covered with a layer of heat-vulcanized silicon rubber having a thickness of 5 mm. Designated by 42 is a heating roller having an outer diameter of 60 mm and comprising an aluminum mandrel of a thickness of 7 mm plated with nickel chromium. The heating roller 42 is urged against the fixing roller and rotated therewith.

The roller surface length of the fixing roller 41 and pressure roller 2 is 320 mm, whereas the contact length (axial length of the heating surface) of the heating roller 42 is 290 mm which is shorter than the maximum paper passage width (the width of JIS A3:297 mm). The opposite end portions of the heating roller 42 are subjected to the thermal float as previously described.

The heating roller 42 is the same as the construction (the convex heater and the heat float of the end portions and surface) in which only the length of the heating roller 1 (which acts as the fixing roller) of FIG. 11 is shortened. The opposite ends of the fixing roller 41 are rotatably supported by bearings 12*c* and 12*d*. The heater 3 corresponds to FIG. 13*e* and has a heating area of 280 mm.

The present embodiment employs the external heating system for the fixing roller, but has the effect of the present invention similar to that of the previously described embodiments.

In the case of the external heating as shown in FIG. 12, it will be more excellent in effect if the length of contact of the heating roller 42 with the fixing roller 41 is made shorter than the maximum paper passage width or the maximum use width.

Again in the fixing devices of Table 4, power saving can be expedited if a reflecting plate and insulating covers are provided therein.

Figure 14:
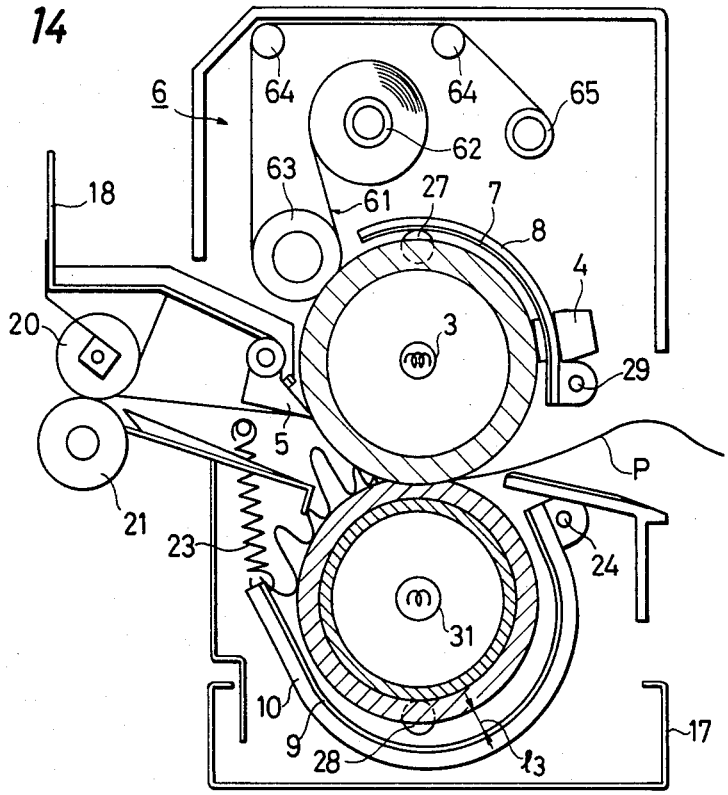
FIG. 14 illustrates jam in the device of FIG. 1.

FIG. 14 shows a case where plain paper P has jammed on the pressure roller side.

When an excessively great pressure is exerted between the pressure roller 2 and the reflecting plate 9 due to paper jam, the reflecting plate 9 moves downwardly about a pivot 24 (the distance l3 between the pressure roller 2 and the reflecting plate 9 becomes greater than the distance l2) to reduce the pressure applied to the pressure roller and reflecting member. Consequently, the pressure roller 2 and reflecting plate 9 can be prevented from being damaged.

In the case of paper jam on the heating roller side, the pressure roller and reflecting plate are also prevented from being damaged in a manner similar to what has been described above. As paper comes between the heating roller and the reflecting plate 7, the reflecting plate 7 resting on a stopper 12 from its own gravity pivots about a pivot 11 due to the presence of the paper. Consequently, the pressure applied to the heating roller 1 and reflecting plate 7 can be reduced, whereby the heating roller 1 and reflecting plate 7 can be prevented from being damaged.

The reflecting plates and covers should preferably move away from the roller surface, and pivots 24 and 29 should preferably be downstream of the direction of rotation of the roller with respect to the reflecting plates and covers.

In the above-described embodiment, the movement of the reflecting plates has been shown as the rotational movement about the pivots 24 and 29, whereas the movement need not always be rotational movement, but the reflecting plates may be pivotable or movable and may be designed to move or retract in a direction to reduce the pressure when an unreasonable extraneous force is applied thereto.

Also, when paper jam is to be released, the paper can be removed while the reflecting members are being retracted from the roller surfaces and this leads to the ease of operation and the possibility of securing safety. Further, when the paper has been removed upon termination of the release of the paper jam, the reflecting plates 7 and 9 can again be held at predetermined positions by spacers 27 and 28.

Accordingly, the roller surfaces and reflecting members can maintain their characteristics for a long period of time without being damaged by the pressure resulting from paper jam, and this leads to the enhanced reliability of the fixing device.

Figure 15:
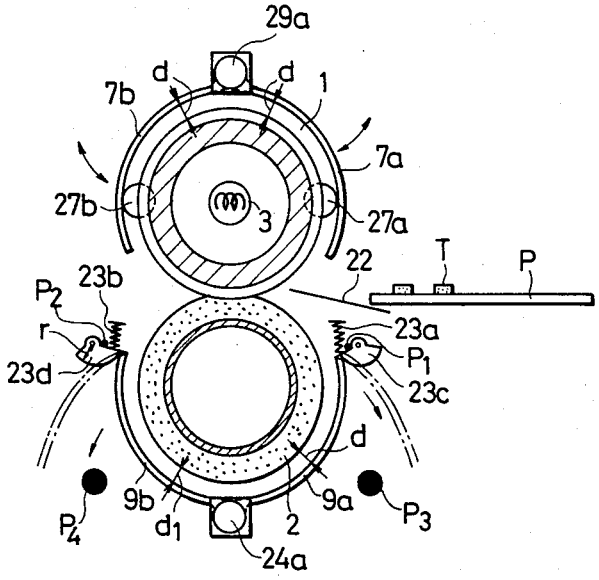
FIG. 15 illustrates still a further embodiment of the present invention.

While in the above-described embodiment the reflecting plates and insulating covers are rotatable about one end thereof, the center of rotation (or movement) thereof may be provided at the central portion of the reflecting plates and insulating covers so that they are foldable into two pieces (see FIG. 15).

The center of rotation may preferably be a location which readily absorbs the pressure during jam, and may more preferably be located at the entrance for the support member before subjected to the fixing treatment, with respect to the entire fixing device.

The construction of FIG. 15 will hereinafter be described briefly.

Around and in proximity to the heating roller 1 having the heater 3 therein, there are provided heat-reflecting members 7*a* and 7*b* so as to cover the peripheral surface of the roller, and around and in proximity to the pressure roller 2, there are provided heat-reflecting members 9*a* and 9*b* so as to cover the peripheral surface of the roller.

The heat-reflecting members 7*a* and 7*b* are pivotally supported about a common pivot shaft 29*a* and spaced apart from the surface of the heating roller 1 by a predetermined gap d by spacers 27*a* and 27*b* (fixedly supported on the immovable portion of the apparatus). The spacers 27*a* and 27*b* are located outside the area through which paper of maximum size passes, with respect to the axial direction of the heating roller, and are in contact with the opposite ends of the axial length of the heat-reflecting members 7*a*, 7*b*. Also, in this condition, the heat-reflecting members 7*a* and 7*b* are disposed concentrically with the roller surface with respect to the center of the heating roller. The heat-reflecting members 7*a* and 7*b* are of such a weight that they can easily escape upwardly upon entry of a support member such as paper, and are normally in contact with the spacers 27*a* and 27*b*, respectively, due to their own gravity.

The heat-reflecting members 9*a* and 9*b* are pivotally supported about a common pivot shaft 29*a*. In the condition shown, the members 9*a* and 9*b* are held so as to be concentric (a gap d1) with the roller surface with respect to the center of the pressure roller.

The holding means therefor may be of such a construction that the heat-reflecting members 9*a* and 9*b*, when pushed with a predetermined or greater pressure, can be moved from the position of said gap d1 in a direction away from the roller surface. An example of it is shown in FIG. 15. Designated by 23*c* and 23*d* are cams rotatable at predetermined positions. Curved surfaces of curvature r are normally in contact with the heat-reflecting members 9*a* and 9*b* to maintain said gap d1.

The cams 23*c* and 23*d* receive an upward force corresponding to said predetermined pressure by means of springs 23*a* and 23*b* secured at one end to a fixed portion provided above the cams and secured at the other end to the cams 23*c* and 23*d*. Designated by P1 and P2 are stoppers which block rotation of the cams 23*c* and 23*d* so that the heat-reflecting members 9*a* and 9*b* do not approach the roller surface beyond the gap d1. Denoted by P3 and P4 are stoppers each having an elastic material on the surface thereof. The stoppers P3 and P4 determine the maximum amount of opening of the heat-reflecting members 9*a* and 9*b* when the heat-reflecting members 9*a* and 9*b* are spaced apart from the cams 23*c* and 23*d* by receiving a predetermined or greater pressure during jam.

In this manner, the heat-reflecting member (including a case where it has an insulating material on the outer surface thereof) divided into two is provided for the roller and this permits the presence of a support member to be readily known during jam and also permits the support member to be readily removed. Also, the provision of the common pivot shaft for the divided heat-reflecting members enables the amount of movement of the heat-reflecting members to be reduced and this leads to compactness of the device.

The construction of the present embodiment is particularly effective when the heated rotational member is maintained in thermally floated condition, and also is effective for an arrangement in which the cover members are brought into proximity to the roller surface to enhance the heat efficiency.

In the above-described respective embodiments, description has been made of heat-reflecting plates (members) or combinations of the reflecting plates and insulating covers, but the present embodiment is also applicable to an arrangement in which only the covers for preventing heat radiation are provided around the rotational member such as the fixing roller (or belt).

As is apparent from the foregoing description, movable or pivotable cover members are provided for the conveying members and therefore, the cover members and the conveying members are not damaged by an accident such as paper jam and thus, the durability thereof can be enhanced. Further, the operability of paper removal in the case of paper jam has become better.

A preferred example of the heat radiation preventing member 7, 8; 9, 10 comprising a heat-reflecting surface and an insulating material will hereinafter be described in detail.

The heat radiation preventing members 8 and 10 were obtained as by blending 3 to 30% of heat-resistant resin such as phenol resin with inorganic fiber such as glass wool or rock wool and pressmolding the blend while applying heat thereto. The heat conductivity of this material differs depending on the fiber diameter, the fiber density, etc., and is 0.038 K cal/m.h.° C. for fiber diameter of 7–8 μm and density of 80 kg/m$^3$, said value being about 1/5 of the heat conductivity of ordinary resin material. This means an excellent insulating performance. The entire end portions of these members were pressed with a pressure force greater than that used during said press-molding, so as to provide a density of 300 kg/m$^3$ or more.

Further, the thin metal surface layers 7 and 9 of the heat radiation preventing members were obtained by press-molding metal foil such as aluminum foil or stainless steel foil through a sheet of thermoplastic resin such as polyethylene or polysulfon simultaneously with the heat radiation preventing members. If this is done, the sheet of thermoplastic resin is melted by heat and said metal foil is bonded to the surface of the heat radiation preventing members, whereby a reflecting surface can be obtained on the surface of the heat radiation preventing members without the number of steps being increased.

Thus, the heat radiation preventing members can sufficiently perform the function of reflecting the radiant heat from the heated member such as roller 1 and at the same time, the thickness of the thin metal surface layers 7 and 9 can be made smaller. That is, the conventional reflecting plate has required the strength and heat capacity thereof to be increased, whereas in the present example the heat radiation preventing members have a sufficient strength and the heat capacity thereof can be minimized. The thickness of the thin metal surface layers 7 and 9 should preferably be in the range of what is called foil, namely, 5 to 300μ.

That is, if the thickness of the thin metal surface layers 7 and 9 is 5 to 300 μm, the heat capacity of themselves becomes smaller to thereby provide a very good heat reflecting efficiency. Also, these thin metal surface layers 7 and 9 are in intimate contact with the heat radiation preventing members 8 and 10, respectively, and lie on the heated member side and therefore, the heat conduction and heat radiation from the thin metal surface layers as the reflecting members can be remarkably decreased and the reflecting efficiency thereof can be enhanced. That is, the thin metal surface layers 7 and 9 and the heat radiation preventing members enhance their own respective functions and achieve an excellent heat radiation preventing effect. Accordingly, the heat in the heating roller which is an example of the heated member can be effectively utilized for fixation. Also, the heat radiation is remarkably decreased and this leads to the possibility of reducing the time required for the heating roller to reach a predetermined temperature by being heated.

The mixture of the inorganic fiber and resin is compressed and therefore, the heat radiation preventing effect thereof is high and the thickness thereof can be made smaller.

A further feature of the above-described embodiment is that since the heat radiation preventing members are compressed to substantially the same curvature as the curvature of the rotational members (such as the rollers), they can most efficiently reflect the radiant heat from the heating roller to feed back it to the roller surface.

As another embodiment, metal foil is heated and press-molded on a mixture of resin and glass fiber whose strength is obtainable relatively easily (or glass fiber which itself has resin) with thermoplastic resin interposed therebetween, to thereby form the heat radiation preventing member. Where fiber having a fiber diameter of 7–8μ is used as such fiber, if the density thereof is 50 kg/m$^3$ or more, there can be obtained a rigidity which enables the single piece to maintain its shape, and the means for supporting this is only required to support one end of the heat radiation preventing member.

Again in case glass fiber is used as described above, the reflecting efficiency and heat radiation preventing effect can likewise be enhanced.

A further embodiment will now be described. This embodiment, as shown in the description of FIG. 2, consists in making the fiber density of the end portions of the heat radiation preventing member composed of inorganic fiber, particularly minute fiber, higher than that of the other portion. That is, a member formed of such fiber may permit scattering of the fiber from the end portions thereof. To prevent such a disadvantage, if the fiber is compressed during the molding so that the fiber density at or near the end portions is 300 kg/m$^3$ or more, a more preferable effect will be provided. Thus, if this is done, the scattering of the fiber can be prevented without the step of applying an adhesive to the end portions being added.

As described above, by providing a heat radiation preventing member whose surface at least on the roller side is enhanced in reflecting efficiency, there has been obtained a fixing device which is inexpensive, light in weight and capable of efficient heat radiation prevention.

The above-described embodiments have been shown as having the heat radiation preventing members provided for the fixing roller, the heating roller and the pressure roller, but the present invention is particularly effective for a heated conveyor belt or a heated rotational member (such as a cylinder of glass-like material) and is also applicable to the reflector of a flash lamp which is heated without being rotated.

While the heat radiation preventing members have been shown as being formed of a mixture of inorganic fiber and heat-resistant resin, or a mixture of glass fiber and heat-resistant resin, or solely glass fiber, the present invention is not restricted thereto but the heat radiation preventing members may be formed of any inorganic fiber containing a resin component.

In the above-described embodiments, both of the distances l1 and l2 should preferably be 0.2 to 20 mm, and more preferably be 5 mm or less.

The heat-resistant resin material mixed with or contained in inorganic fiber may be not only the phenol resin but also resin such as PPS, polyimide, PBT, tetrafluoroethylene or polyamide.

As is apparent from the foregoing description, the device of the present invention has members having a higher heat radiation preventing effect than the conventional ones and such members can decrease the heat radiation from the heated member and effectively impart the heat from the heating means to the heating member.

Figure 16:
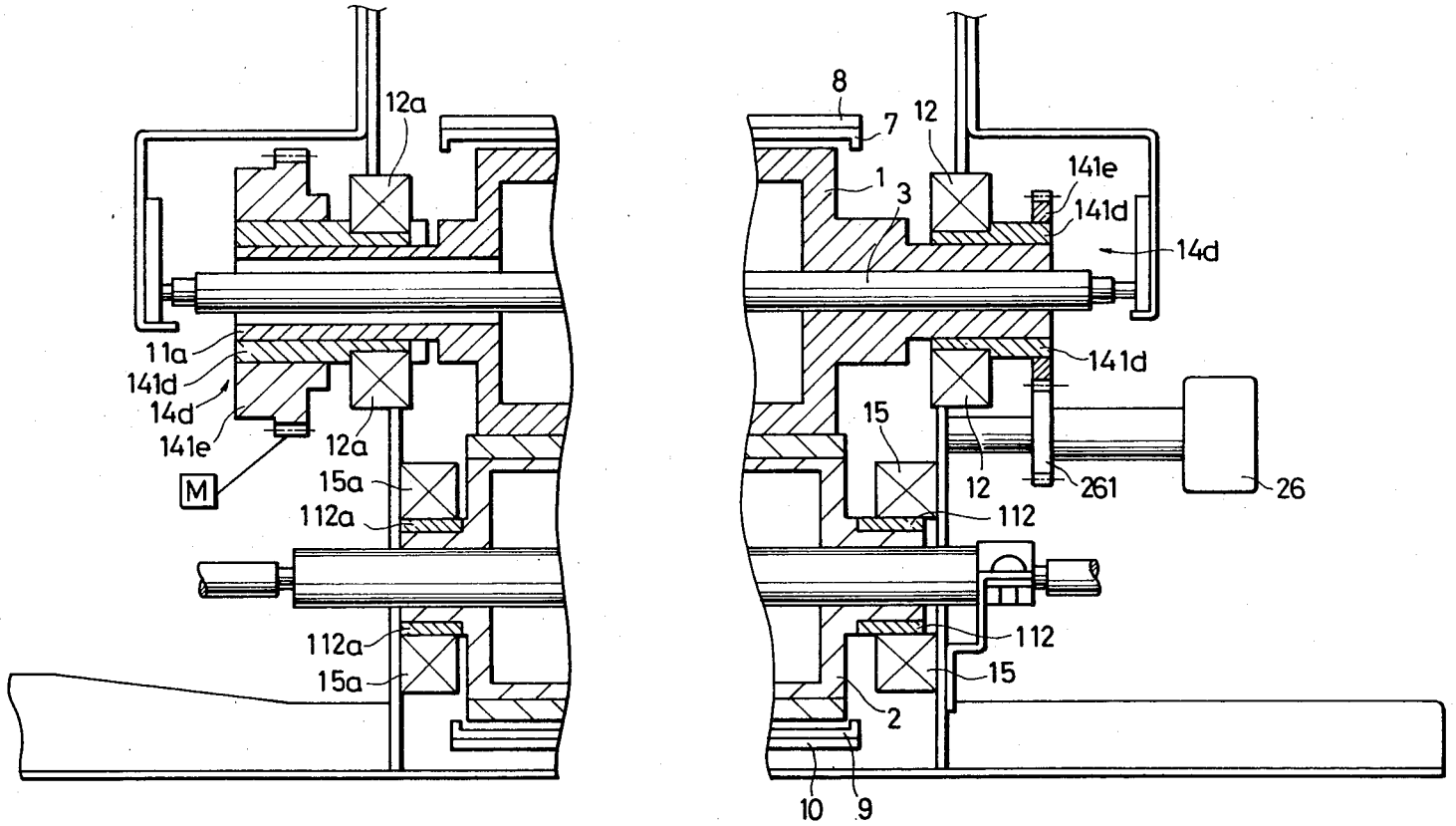
FIG. 16 illustrates yet a further embodiment of the present invention.

FIG. 16 shows an embodiment in which heat radiation preventing means are also provided for the end portions of a roller having heating means therein or a heated roller.

The construction of FIG. 16 is similar to the construction of FIGS. 1 and 2 with the exception that instead of the gears 14, 14*a* and the sleeves 111, lll*a*, there is provided a gear 14*d* having a resin layer 141*d* in which the insulating portions of gears and sleeves are made integral with each other and a metal layer 141*e* having a toothed portion for mesh engagement. This gear 14*d* is such that the insulating layer of its gear portion is thicker than its sleeve portion, as shown in the description of FIGS. 6–8, and it is constructed in its engaged condition as shown in FIG. 7. The other difference in construction is that sleeves 112 and 112*a* formed of an insulating material are provided between the shaft of the pressure roller 2 and bearings 15, 15*a*.

The sleeves 112 and 112*a* are of a greater width than the width of the bearings 15 and 15*a*. Thus, even if the pressure roller 2 shifts more or less to the left or to the right, the heat loss from the end portions of the pressure roller can be intercepted.

This heat interception on the pressure roller 2 side is particularly effective in case the pressure roller 2 has a heating source therein, as well as in case the pressure roller 2 has no heating source therein.

The reason is as follows: if the heating roller side is kept in thermally floated condition, heat loss may occur from the end portions of the pressure roller which is in contact with the heating roller; accordingly, if heat-intercepting members are provided at the end portions of the pressure roller 2, the thermally floated condition of the heating roller can be further improved.

Again in this embodiment, a more preferable effect will be provided as previously noted if the heating distribution of the heater 3 is rendered into the previously described condition or the reflecting plate 7 and insulating cover 8 are provided.

Also, where there is provided a mechanism for transmitting the drive to the pressure roller 2 side, the construction provided on the heating roller can be applied to the pressure roller 2 side.

The features of each embodiment have been described above, and to maintain the thermally floated condition to a higher degree, the entire contact portions of the members in contact with the rotational member such as the fixing roller, for example, the members such as drive transmitting gears and support means, should preferably be composed of a heat-resistant and insulating material.

By the reflecting plates and covers being movably or rotatably supported as in the above-movably described embodiments, any support member jammed or coiled around the rotational members such as the heating and pressure rollers can be easily removed therefrom.

While the above embodiments have been described with respect only to the heating roller, the present invention is also applicable to the pressure roller 2 or other members concerned in fixation. Speaking from another point of view, the present invention is also applicable to an image bearing member such as a photosensitive member having a heat source therein.

Although the above embodiments have been described with respect to the internal heating type fixing roller, the present invention is also applicable to a roller having an external heating means or other members heated by conducted heat.

In the above-described embodiments, by providing a thermal barrier to thermally float the fixing roller (of course, the pressure roller may be floated), providing the heat radiation preventing members and reflecting members, and intensifying the heating distribution of the heater in the central portion thereof, there has been obtained a fixing device which can achieve good fixation by using a small amount of electric power.

The above-described embodiments are preferable ones in which, for the region rotatably supporting the heating roller, a heat-intercepting sleeve is provided between the bearing and the heating roller, but use may be made of a plain bearing which itself has a heat-intercepting property, or a heat-intercepting member may be provided near the bearing, or the frame member itself may be formed of a heat-intercepting material.

Heat-intercepting or insulating support means provided for the members concerned in fixation are applicable to the above-described embodiments. Preferably, the heat-intercepting support means may be provided at a station around the roller shaft or near the heat-emitting portion such as the roller itself.

Also, in the above-described embodiments, the gears mounted on the heating roller are made heat-intercepting, but a connecting system member or a drive system member for the members concerned in fixation such as the heating roller, etc. may be incorporated in the present invention if it has a heat-intercepting property. Further, a member provided near or on the members concerned in fixation (which member is not shown, but will become apparent from this description) is particularly preferable.

The sleeves and gears, which normally are in contact with other members, should preferably have a wear resisting property.

Although, in the above-described embodiments, the heat treatment and recording of the object to be heated has been described with the heating-fixing device of an image recording apparatus, the present invention is also applicable to a so-called dry silver device (which, in this field, is called a developing device) in which an image is heat-treated and stabilized for a desired period of time.

The present invention is particularly effective for a device which effects heat treatment at a high temperature, and achieves an appreciable effect in a fixing device which effects heat treatment at 100° C. or higher.

According to one aspect of the present invention, as described above, the rotational members heated by heating means can be maintained thermally stable and waste of heat can be greatly reduced.

According to another aspect of the present invention, as described above, the heat loss from the rotational members can be prevented to a higher degree and the uniform heating of the object to be heated can be accomplished easily, and this leads to the possibility of achieving power saving and enhanced heat efficiency from the heating source to the object to be heated.

As described above, the object to be heated in the present invention include a thermoplastic material such as a toner image, or a support member such as plain paper, or a roller which effects heat treatment (in the previous embodiment, the fixing roller 41). Where a plurality of rollers are used as in the above-described embodiments, insulating members should preferably be interposed between the gears in contact with the rollers and the bearings themselves or between these members and the rollers in order to prevent the heat loss from the end portions of the respective rollers.

What we claim is:

1. A heating device comprising:

a heating roller for heat-treating an object to be heated;

heat loss preventing means provided at end portions of said roller to prevent heat loss from the end portions of said roller resulting from conduction and having heat-resistant insulating members to keep said heating roller under a thermally floated condition;

means for heating said roller, said heating means having a heating member whose heating generating value is larger in the middle portion of said roller than in the end portions of said roller with respect to the longitudinal direction of said roller;

drive means for rotating said heating roller; and means for rotatably supporting said heating roller, and wherein said heat loss preventing means has an insulating member including a gear of insulating resin fitted to said roller at portion whereat said drive means acts on said roller, and an insulating member at a portion whereat said supporting means acts on the end portion of said roller.

2. A heating device comprising:

a heating roller for heat-treating an object to be heated;

heat loss preventing means provided at end portions of said roller to prevent heat loss from the end portions of said roller resulting from conduction and having heat-resistant insulating members to keep said heating roller under a thermally floated condition;

means for heating said roller, said heating means having a heating member with a heating portion only within a range of length equal to or smaller than the maximum width of said object to be heated with respect to the longitudinal direction of said roller;

and further comprising drive means for rotating said heating roller; and means for rotatably supporting said heating roller, and wherein said heat loss preventing means has an insulating member including a gear of insulating resin fitted to said roller at a portion whereat said drive means acts on said roller, and an insulating member at a portion whereat said supporting means acts on the end portion of said roller.

3. A heating device comprising:

a heating roller for heat-treating an object to be heated;

heat loss preventing means provided at end portions of said roller to prevent heat loss from the end portions of said roller resulting from conduction and having heat-resistant insulating members to keep said heating roller under a thermally floated condition;

means for heating said roller, said heating means having a heating member whose heating generating value is larger in the middle portion of said roller than in the end portions of said roller with respect to the longitudinal direction of said roller;

drive means for rotating said heating roller; and means for rotatably supporting said heating roller, and wherein said heat loss preventing means has an insulating member including a gear having an insulating material in at least a portion thereof at a portion whereat said drive means acts on said roller, and an insulating member at a portion whereat said supporting means acts on the end portion of said roller.

4. A heating device comprising:

a heating roller for heat-treating an object to be heated;

heat loss preventing means provided at end portions of said roller to prevent heat loss from the end portions of said roller resulting from conduction and having heat-resistant insulating members to keep said heating roller under a thermally floated condition;

means for heating said roller, said heating means having a heating member with a heating portion only within a range of length equal to or smaller than the maximum width of said object to be heated with respect to the longitudinal direction of said roller;

and further comprising drive means for rotating said heating roller; and means for rotatably supporting said heating roller, and wherein said heat loss preventing means has an insulating member including a gear having an insulating material in at least a portion thereof at a portion whereat said drive means acts on said roller, and an insulating member at a portion whereat said supporting means acts on the end portion of said roller.

5. A heating device comprising:

a heating roller for heat-treating an object to be heated;

heat loss preventing means provided at end portions of said roller to prevent heat loss from the end portions of said roller resulting from conduction and having heat-resistant insulating members to keep said heating roller under a thermally floated condition;

means for heating said roller, said heating means having a heating member whose heating generating value is larger in the middle portion of said roller than in the end portions of said roller with respect to the longitudinal direction of said roller; and drive means for rotating said heating roller and means for rotatably supporting said heating roller, and wherein said heat loss preventing means has an insulating member at a portion whereat said drive means acts on said roller, and an insulating member at a porton whereat said supporting means acts on the end portion of said roller, the insulating member of said support means and the insulating member of said drive means having their insulating portions integral with each other.

6. A heating device comprising:

a heating roller for heat-treating an object to be heated;

heat loss preventing means provided at end portions of said roller to prevent heat loss from the end portions of said roller resulting from conduction and having heat-resistant insulating members to keep said heating roller under a thermally floated condition;

means for heating said roller, said heating means having a heating member with a heating portion only within a range of length equal to or smaller than the maximum width of said object to be heated with respect to the longitudinal direction of said roller; and drive means for rotating said heating roller and means for rotatably supporting said heating roller, and wherein said heat loss preventing means has an insulating member at a portion whereat said drive means acts on said roller, and an insulating member at a portion whereat said supporting means acts on the end portion of said roller, the insulating member of said support means and the insulating member of said drive means having their insulating portions integral with each other.

7. A heating device comprising:

a heating roller for heat-treating an object to be heated;

heat loss preventing means provided at end portions of said roller to prevent heat loss from the end portions of said roller resulting from conduction and having heat-resistant insulating members to keep said heating roller under a thermally floated condition;

means for heating said roller, said heating means being an external heating roller having heat loss preventing means at the end portions thereof and adapted to heat said heating roller and having a heating member whose heating generating value is larger in the middle portion of said roller than in the end portions of said roller with respect to the longitudinal direction of said roller.

8. A heating device comprising:

a heating roller for heat-treating an object to be heated;

heat loss preventing means provided at end portions of said roller to prevent heat loss from the end portions of said roller resulting from conduction and having heat-resistant insulating members to keep said heating roller under a thermally floated condition; and means for heating said roller, said heating means being an external heating roller having heat loss preventing means at the end portions thereof and adapted to heat said heating roller and having a heating member with a heating portion only within a range of length equal to or smaller than the maximum width of said object to be heated with respect to the longitudinal direction of said roller.

9. A heating device according to claim 2, 3, 5, or 7 wherein said heating member is provided a heating portion only within a range of length equal to or smaller than the maximum width of said object to be heated with respect to the lengthwise direction of said roller.

10. A heating device according to claim 2, 4, 6, or 8 wherein said heating portion exhibits a substantially constant heating distribution in the longitudinal direction thereof.

11. A heating device according to any one of claims 2 to 8, wherein said heating roller has a heat-resistant elastic layer on the surface thereof.

12. A heating device according to claim 11, wherein said heat-resistant elastic layer is a thin layer having a thickness of 2 mm or less.

13. A heating device according to any one of claims to 1 to 8, further comprising an elastic-surfaced pressure roller urged against said heating roller and forming a pressure contact width and wherein said object to be heated is heated and pressed in said pressure contact width, wherein said heating means is provided in the interior of said heating roller, and said object to be heated is a support member supporting a toner image thereon.

14. A heating device according to claim 13, wherein said pressure roller has heat loss preventing means provided at the end portions thereof to prevent the heat loss from said end portions.

15. A heating device according to claim 13 wherein the thickness of the elastic surface layer of said pressure roller is greater than the thickness of the elastic layer of said heating roller.

16. A heating device according to claim 1, 2, 3, or 4 wherein the insulating member is a sleeve provided between a bearing and said roller.

17. A heating device according to claim 3 or 6, wherein the insulating member of said supporting means is a sleeve provided between a bearing and said roller, and wherein said insulating member is a gear of insulating resin fitted to said roller.

18. A heating device according to claim 3 or 4, wherein said gear is constituted by an inner layer of insulating resin and an outer layer of a metal, one of said layers having a cut-away and the other layer having a convex portion engaged with said cut-away, said two layers being formed integrally with each other.

19. A heating device comprising:

a heating roller for heat-treating an object to be heated;

heat loss preventing means provided at the end portions of said roller to prevent heat loss from the end portions of said roller and having heat-resistant insulating members;

heating means provided in the interior of said roller;

a heat radiation preventing member provided in proximity to the peripheral surface of said roller so as to cover the peripheral surface of said roller, said heat radiation preventing member having an insulating layer integral with an insulating member composed chiefly of inorganic fiber and a heat-resistant resin material by pressing, and a heat reflecting layer provided in intimate contact with that side of said insulating layer which is adjacent to said roller; and a pressure roller having said heat loss preventing means at the end portions thereof and urged against said heating roller and wherein said pressure roller is also provided with said heat radiation preventing member and said object to be heated is heattreated between said rollers.

20. A heating device according to claim 19, wherein said object to be heated is a support member supporting a toner image thereon.

21. A heating device comprising:

a heating roller for heat-treating an object to be heated;

heat loss preventing means provided at the end portions of said roller to prevent heat loss from the end portions of said roller and having heat-resistant insulating members;

heating means provided in the interior of said roller; and a heat radiation preventing member provided in proximity to the peripheral surface of said roller so as to cover the peripheral surface of said roller, said heat radiation preventing member having an insulating layer integral with an insulating member composed chiefly of inorganic fiber and a heat-resistant resin material by pressing, and a heat reflecting layer provided in intimated contact with that side of said insulating layer which is adjacent to said roller, a said member having a curved surface concentric with the perpheral surface of said heating roller and being provided with a predetermined distance between it and said heating roller.

22. A heating device according to claim 21, wherein said distance is in the range of 0.2–20 mm.

23. A heating device according to claim 22, wherein said distance is 5 mm or less.

24. A heating device comprising:

a heating roller for heat-treating an object to be heated;

heat loss preventing means provided at the end portions of said roller to prevent heat loss from the end portions of said roller and having heat-resistant insulating members;

heating means provided in the interior of said roller; and a heat radiation preventing member provided in proximity to the peripheral surface of said roller so as to cover the peripheral surface of said roller, said heat radiation preventing member having an insulating layer integral with an insulating member composed chiefly of inorganic fiber and a heat-resistant resin material by pressing, and a heat reflecting layer provided in intimate contact with that side of said insulating layer which is adjacent to said roller.

said heat reflecting layer being metal foil and said member being formed by superposing said metal foil and said insulating layer one upon the other with thermoplastic resin interposed therebetween and heating and press-molding the same.

25. A heating device comprising:

a heating roller for heat-treating an object to be heated;

heat loss preventing means provided at the end portions of said roller to prevent heat loss from the end portions of said roller and having heat-resistant insulating members;

heating means provided in the interior of said roller; and a heat radiation preventing member provided in proximity to the peripheral surface of said roller so as to cover the peripheral surface of said roller, said heat radiation preventing member having an insulating layer integral with an insulating member composed shiefly of inorganic fiber and a heat-resistant resin material by pressing, and a heat reflecting layer provided in intimate contact with that side of said insulating layer which is adjacent to said roller, and the fiber density of said insulating layer at the end portions thereof being 300 kg/m$^3$ or more.

26. A heating device comprising:

a heating roller for heat-treating an object to be heated;

heat loss preventing means provided at the end portions of said roller to prevent heat loss from the end portions of said roller and having heat-resistant insulating members;

heating means provided in the interior of said roller; and a heat radiation preventing member provided in proximity to the peripheral surface of said roller so as to cove the peripheral surface of said roller, said heat radiation preventing member having an insulating layer integral with an insulating member composed chiefly of inorganic fiber and a heat-resistant resin material by pressing, and a heat reflecting layer provided in intimate contact with that side of said insulating layer which is adjacent to said roller, and the end portions of said insulating layer having a higher fiber density than the other portion.

27. A heating device comprising:

a heating roller for heat-treating an object to be heated;

heat loss preventing means provided at the end portions of said roller to prevent the heat loss from the ends of said roller and having heat-resistant insulating members;

heating means provided in the interior of said roller;

a first radiation preventing member provided in proximity to the peripheral surface of said roller so as to cover the peripheral surface of said roller; and first means for supporting said heat radiation preventing member so that said first heat radiation preventing member is movable away from the surface of said roller by an acting force created when said object to be heated strikes against said first heat radiation preventing member.

28. A heating device according to claim 27, further comprising a pressure roller urged against said heating roller and a second heat radiation preventing member provided in proximity to the peripheral surface of said pressure roller so as to cover the peripheral surface of said pressure roller; and second means for supporting said second heat radiation preventing member so that said second heat radiation preventing member is movable away from the surface of said pressure roller by an acting force created when said object to be heated strikes against said second heat radiation preventing member and said object to be heated is heat-treated between said rollers.

29. A heating device according to claim 27 or 28, wherein said first supporting means has a stopper for holding said first heat radiation preventing member at a predetermined distance from the surface of said heating roller and a pivot point provided downstream of said heat radiation preventing member with respect to the direction of rotation of said heating roller, and said first heat radiation preventing member is caused to bear against said stopper and can pivot around said pivot point.

30. A heating device according to any one of claims 19, 21 or 24 to 27, further comprising drive means for rotating said heating roller and wherein said heat loss preventing means has an insulating gear of in insulating resin at a portion whereat said drive means acts on said roller.

31. a heating device according to any one of claims 19, 21 or 24 to 27, further comprising means for rotatably supporting said heating roller and drive means for rotating said heating roller, wherein said heat loss preventing means has an insulating member at a portion whereat said supporting means acts on said roller and an insulating member at a portion whereat said drive means acts on said roller.

32. A heating device according to claim 31, wherein said heating means has a heating member whose heating value is greater in the central portion of said heating roller than in the end portions of said heating roller with respect to the longitudinal direction of said heating roller.

33. A heating device according to claim 32, wherein said heating member include a heating portion provided only within a range of length equal to or smaller than the maximum width of said object to be heated with respect to the longitudinal direction of said roller.

34. A heating device according to claim 31 wherein said heating means has a heating portion only within a range of length equal to or smaller than the maximum width of said object to be heated with respect to the longitudinal direction of said heating roller.

35. A heating device according to claim 34, wherein said heating portion exhibits a substantially constant heating distribution in the longitudinal direction thereof.

36. A heating device according to any of claims 21 to 27, wherein said device has a pressure roller which presses said object to be heated to said heating roller and carries said object, and said object to be heated is a support member supporting a toner image thereon.

37. A heating device according to claim 34, wherein said object to be heated is a support member supporting a toner image thereon.

38. A heating device according to claim 32, wherein said object to be heated is a support member supporting a toner image thereon.

39. A heating device comprising:

a heating roller and a press roller for conveying an object to be fixed between the two rollers to fix a toner image on the object;

a heating member provided in said heating roller; and a heat insulating member for preventing the heat loss from the end portions of said heating roller;

the heating roller having a heating distribution in which the portion of the heating roller positioned on one side of the object conveyed with the one side edge thereof being coincident with one end of the heating member, is heated more strongly than that portion of the heating means other than the portion corresponding to said one side of the object, said heating device further comprises a support member for rotatably supporting said heating roller and transmitting means for transmitting the driving force to said heating roller, and said heat insulating member being provided on the portion where said support means and said transmitting means contact each other, whereby, said heating roller is kept under a thermal floated condition said side edge of said object being determined on the basis of its conveyance direction.

40. A heating device comprising:

a heating roller and a press roller for conveying an object to be fixed between the two rollers to fix a toner image on the object;

a heating member provided in said heating roller; and a heat insulating member for preventing the heat loss from the end portions of said heating roller;

the heating roller having a heating distribution in which the portion of the heating roller positioned on one side of the object conveyed with the one side edge thereof being coincident with one end of the heating member, is heated more strongly than that portion of the heating means other than the portion corresponding to said one side of the object, said heat insulating member comprising a gear made of resin and attached on the heating roller for transmitting the driving force to one end of the heating roller; and a heat insulating bush provided on the portion on which a support member for rotatably supporting the both ends of the heating roller contacts with the heating roller.

41. A heating device according to claim 40, wherein said heating device further comprises transmitting means for transmitting the manually rotational force to the other end of the heating roller and a gear made of resin and attached on the other end of the heating roller.

42. A heating device according to claim 40, wherein said heating member is a heater which has a heat generating portion indicating maximum heating value on the middle portion of the heating member which lies more toward said side edge than the center line with respect to the longitudinal direction of the heating roller and substantially heats the whole length of the heating roller.

43. A heating device comprising:

a heating roller and a press roller for conveying an object to be fixed between the two rollers to fix a toner image on the object;

a heating member provided in said heating roller; and
a heating insulating member for preventing the heat loss from the end portions of said heating roller;
the heating roller having a heating distribution in which the portion of the heating roller positioned on one side of the object conveyed with the one side edge thereof being coincident with one end of the heating member, is heated more strongly than that portion of the heating means other than the portion corresponding to said one side of the object, said heating member being a heater having a heat generating portion indicating maximum heating value on the middle portion of the heating member which lies more toward said side edge than the center line with respect to the longitudinal direction of the heating roller.

44. A heating device comprising:
a heating roller for heat-treating an object to be heated;
first transmitting means for transmitting driving force to one side of the heating roller;
second transmitting means capable of transmitting manually rotational force to the other side of the heating rollers;
heating means provided within said heating roller;
heat loss preventing means provided at end portions of said roller to prevent heat loss from the end portions of said roller, said heat loss preventing means having heat-insulating member for transmitting the driving force at each of the positions where said first transmitting means and said second transmitting means act to said heating roller.

45. A heating device according to claim 44, wherein said heating means has a heater with substantially constant heating distribution.

46. A heating device according to claim 45, wherein said heat loss preventing means has a heat-insulating member at the position where a supporting means for rotatably supporting said heating roller acts to said heating roller.

47. A heating device according to claim 46, wherein said first transmitting means is a resin gear made of resin material.

48. A heating device according to claim 47, further comprising a pressing roller which rotates contacting with said heating roller each other to heat and fix a toner image on a supporting member with said object to be heated.

49. A heating device according to claim 46, wherein said heating means has a heating portion only within a range of length equal to or smaller than the maximum width of said object to be heated.

50. A heating device according to claim 44, wherein said heating means has a heater whose heating value is larger in the middle portion of said roller than in the end portions of said roller with respect to the longitudinal direction of said roller.

51. A heating device according to claim 50, wherein said heat loss preventing means has a heat-insulating member at the position where supporting means for rotatably supporting said heating roller acts to said heating roller.

52. A heating device according to claim 51, wherein said first transmitting means is a resin gear made of resin material.

53. A heating device according to claim 52, further comprising a pressing roller which rotates contacting with said heating roller each other to heat and fix a toner image on a supporting member with said object to be heated.

54. A heating device according to claim 50, wherein said heater has a heating portion only within a range of length equal to or smaller than the maximum width of said object to be heated.

55. A heating device comprising:
a heating roller and a pressing roller for carrying a supporting member therebetween to heat and fix non-fixed image on said supporting member;
a heater provided within said heating roller for exhibiting a substantially constant heating distribution in the longitudinal direction thereof;
supporting means for rotatably supporting end portions of said heating roller;
transmitting means for transmitting the driving force from a driving source to one side of the end portions of said heating roller;
heat loss preventing means having a heat-insulating member provided at the portion where said supporting means acts to said heating roller, for preventing conduction heat loss, and a heat-insulating resin gear attached on said heating roller and provided at the portion where said transmitting means acts to said heating roller, said heat loss preventing means keeping said heating roller under a thermally floated condition and a surface temperature distribution of said heating roller becoming uniform in the longitudinal direction of said heating roller.

56. A heating a device according to claim 55, wherein said heating device has a heat radiation-preventing member for preventing the decrease of the temperature of said heating roller which is caused by the radiation from the surface of said heating roller, and said radiation preventing member is a heat insulation layer integral with a heat reflecting layer closely contacting with the side of the heat insulation layer facing to said heating roller, and is located so as to cover the peripheral surface of said heating roller in the longitudinal direction thereof.

57. A heating device according to claim 55, wherein said heat-insulating member is provided at the both end portions of said heating roller and one of said heat-insulating members is integral with said heat-insulating resin gear.

58. A heating device according to claim 56, wherein said heat insulating member is provided at the both end portions of said heating roller and one of said heat-insulating member is integral with said heat-insulating resin gear.

59. A heating device comprising:
a heating rollar and a pressing roller for carrying a supporting member therebetween to fix non-fixed image on said supporting member;
heating means provided within said heating roller;
supporting means for rotatably supporting said heating roller;
driving means for rotating said heating roller; and
heat loss preventing means having a heat-insulating member provided at the portion where said supporting means act to support said heating roller, and a heat-insulating resin gear provided at the portion where said driving means act to rotate said heating roller.

60. A heating device according to claim 59, wherein said supporting means is a bearing to support the heating roller, and said heat-insulating member locates between said bearing and the heating roller.

61. A heating device according to claim 59, wherein said heat-insulating member is a bearing supporting said heating roller.

* * * * *

UNITED STATES PATENT AND TRADEMARK OFFICE

CERTIFICATE OF CORRECTION

PATENT NO. : 4,618,240

DATED : October 21, 1986

INVENTOR(S) : MASAAKI SAKURAI, ET AL.

It is certified that error appears in the above-identified patent and that said Letters Patent is hereby corrected as shown below:

Column 1, line 47, after "or" insert --to--.

Column 2, lines 1-2, change "compatibility" to --capability--

Column 4, line 49, change "ll" to --ℓl--.

Column 7, line 62, after "35 μm" insert --,--.

Column 8, last line of table should be moved to next column.

Column 10, line 8, change "f" to --fixing--.

Column 14, line 64, change "a" to --*a*--;
line 67, change "b" to --*b*--;
line 68, change "c-e" to --*c*-*e*--.

Column 21, line 59, change "111a" to --111a--.

Column 22, line 37, delete "movably ".

Column 29, line 51 (Claim 33, line 2), change "include" to --includes--.

Signed and Sealed this

Thirteenth Day of January, 1987

*Attest:*

*Attesting Officer*

DONALD J. QUIGG

*Commissioner of Patents and Trademarks*